US005679056A

United States Patent [19]

Coussens

[11] Patent Number: 5,679,056

[45] Date of Patent: Oct. 21, 1997

[54] DRUM SANDER ATTACHMENT FOR A POWER TOOL AND METHOD OF USING

[76] Inventor: Robert D. Coussens, 2844 Buttrick SE., Ada, Mich. 49301

[21] Appl. No.: 576,333

[22] Filed: Dec. 21, 1995

[51] Int. Cl.[6] ..... B24B 1/00; B24B 23/02; B24D 9/02

[52] U.S. Cl. ..... 451/28; 451/59; 451/358; 451/495; 451/504; 451/508; 451/521

[58] Field of Search ..... 451/358, 495, 451/504, 505, 508, 521, 28, 59, 178, 340, 342, 360

[56] References Cited

U.S. PATENT DOCUMENTS

| | | | |
|---|---|---|---|
| 2,494,818 | 1/1950 | Kristek | 451/505 |
| 2,554,763 | 5/1951 | Wickman | 451/358 |
| 3,438,154 | 4/1969 | Vichi | 51/135 |
| 3,496,679 | 2/1970 | Dunn | 51/170 |
| 3,596,411 | 8/1971 | Hutchins | 51/170 |
| 3,815,290 | 6/1974 | McDowell | 51/170 PT |
| 3,848,374 | 11/1974 | Hasegawa | 51/373 |
| 3,965,521 | 6/1976 | Wardell | 451/504 |
| 4,177,611 | 12/1979 | Carr-Rollet | 51/376 |
| 4,437,270 | 3/1984 | Langstraat | 51/364 |
| 4,558,538 | 12/1985 | Green | 51/72 R |
| 4,587,770 | 5/1986 | Lindberg | 51/170 EB |
| 4,692,958 | 9/1987 | McMakin | 451/508 |
| 4,720,940 | 1/1988 | Green | 51/166 R |
| 4,837,985 | 6/1989 | Mayama | 51/364 |
| 4,850,158 | 7/1989 | Schaffner | 451/508 |
| 4,869,026 | 9/1989 | Burrell | 51/135 R |
| 4,993,192 | 2/1991 | Demetrius | 451/358 |
| 5,038,525 | 8/1991 | Gardner | 451/358 |
| 5,269,874 | 12/1993 | Winter | 451/358 |
| 5,351,447 | 10/1994 | Grauert | 451/495 |

*Primary Examiner*—Timothy V. Eley

[57] ABSTRACT

A drum sander attachment used with a rotary-driven power new or recycled container (50) as a dram secured to a shaft (54) with a drive means attached. The securing means having capability of sealing for purposes of producing a desired and/or firmness to the recycled container (50) drum. The vast assortment of recycled containers (50) available produce a variety of shapes and sizes for drum use allowing for abrading of both curved and flat surfaces. The design allows for repositioning of recycled container (50) on shaft (54) for a variety of configurations. The unit is constructed to be selectively portable or mounted in a stationary manner.

21 Claims, 23 Drawing Sheets

DRUM SANDER ATTACHMENT FOR A POWER TOOL AND METHOD OF USING

BACKGROUND-FIELD OF INVENTION

This invention relates to an attachment for rotary-driven surface-treating tools such as sanders and other abrading tools, polishing units, and the like which would be attached to a power source, specifically to such as would be used for the sanding or buffing of curved or flat surfaces.

BACKGROUND-DESCRIPTION OF PRIOR ART

A review of drum and belt abrading tools reveal a multitude of short-comings. The drum sander is typically a rigid drum of a standard size to accommodate a pre-formed sanding sleeve or have some attaching means to use sheet sandpaper. The drum may, or may not have padding to aid in conforming to the surface being abraded and possibly a support handle on the opposite side of the power unit/ typically an electric drill.

BACKGROUND-PRIOR ART, DRUM SANDERS

Upon deciding the drum sander as the tool of choice, the first problem is in finding the product. The typical drum sander handled by the retail system is the "hobbyist" size for model work. It is undersized and underpowered for such tasks as deck finishing or cabinet building.

Having found a tool store that can "special order" a drum sander, the next problem is the limited size selection. One, two, or three-inch drum widths are common. A four-inch size is rare, but attainable if an industrial supplier can be found. Surfaces that are greater than the drum width require multiple passes. This results in uneven finishes and extended abrading time.

The next challenge is the cost. The basic drum sander is relatively costly. If you have any features at all, such as a support handle as shown in U.S. Pat. No. 3,596,411 to Hutchins (1970), quick-releasable sandpaper holder as demonstrated in U.S. Pat. No. 4,837,985 to Mayama (1988) and U.S. Pat. No. 4,437,270 to Langstraat (1984), or a treated drum surface for contour sanding as illustrated in U.S. Pat. No. 4,177,611 to Carr-Rollet (1978), be prepared to pay considerably more. If the drum is designed to use a pre-formed sleeve sandpaper, the attaching means to the drum will be generally easy, but at a price. Sleeve sandpaper is quite rigid and does not allow for sanding in contours. Secondly the cost of sleeve sandpaper is ten to twenty times the cost of sheet sandpaper.

As in most tool applications, one size does not fit all circumstances. The drill power source can be changed to accommodate various speeds and power output, but the drum is one size, one weight, and the placement on the axle is static.

The drum can be found mounted to stationary power sources as in U.S. Pat. No. 4,720,940 to Green (1988) where the power source is a radial arm power saw, or as in U.S. Pat. No. 4,558,538 a continuation-in part of U.S. patent application Ser. No. 352,957 (filed 1982) where the power source is permanently mounted in a vertical position over a flat support surface. Each instance shows inherent inflexibility in tool design.

The sanding process causes a great amount of heat to be produced at the contact area where the abrading material meets the surface being treated. This results in a premature breakdown of the abrading material. This problem is addressed in U.S. Pat. No. 3,815,290 to McDowell (1974).

While the abrading material in this instance is attached to a drum, the motion produced is that of a disc sander. The heat dissipation referred to is that of air circulation which does little more than would a dust vacuum. Another model as shown in U.S. Pat. No. 3,848,374 to Hasegawa (1972) employs a pressure jacket around the drum used for the purpose of engaging the abrading sleeve to the drum. The cooling effect on the abrading area would be negligible due to the minimum amount of fluid used in the jacket.

The drum weight has an effect on the abrading process. Too light a tool bounces easily and produces a wavy pattern on the surface being abraded. Too heavy a tool can result in gouging the surface, as well as arm fatigue after extended use.

In summary, the existing drum sanders are found to be deficient in the following areas:

(a) Difficult to find, (b) Limited sizes available, (c) Costly price tags, (d) Sleeve sandpaper is expensive and rigid, (e) Lack of flexibility in tool configuration, (f) Inability to change drum size, both in width and diameter, (g) Cannot vary drum weight, (h) Heat production at contact area breaks down abrading material, and (i) Limited ability to conform to contours.

BACKGROUND-PRIOR ART, BELT SANDERS

The belt sander is the more common sander found in retail stores. Economy model prices begin slightly less than that of the basic drum sander. As features are added, prices quickly reach the high-end drum sander range. The cost of belt sandpaper is seven to twenty times the cost of sheet sandpaper. There is no way of converting the belt sander to use sheet sandpaper.

By design, the belt sander is bulky. It obstructs the user's vision of the area being abraded. Its large, flat abrading area results in an inability to finely adjust the pressure in areas being abraded. The belt sander presented by U.S. Pat. No. 3,496,679 to Dunn (1970) addresses this problem, but in doing so severely limits the belt width for greater handleability.

Adjusting the power source is limited to a variable speed feature only if that particular belt sander possesses that feature. Two belt sanders, U.S. Pat. No. 4,587,770 to Lindberg (1984) and U.S. Pat. No. 4,869,026 to Burrell (1989) do use a drill power source. The first sighted patent is extremely bulky and designed to use only a drill with a top handle mount. The second is a speciality tool for de-burring cylindrical or curved shapes.

The normal power source is incorporated as part of the tool as illustrated in U.S. Pat. No. 3,496,679 to Dunn (1970), U.S. Pat. No. 3,596,411 to Hutchins (1970) and U.S. Pat. No. 4,558,538 a continuation-in-part of U.S. patent application Ser. No. 352,957 (filed 1982). As such, it is unadaptable to individual user needs. It is also incapable of reversing direction, which in some applications is desired.

The sanding of contours is nearly impossible. Most belt sanders have a backing pad behind the belt sandpaper at the area of contact with the material to be abraded as illustrated in U.S. Pat. No. 3,438,154 to Vichi (1969). This is not sufficient to allow the rigid sandpaper belt to conform to the contours of the surface being abraded. It is necessary for tracking on the rollers of the belt sander that the belt sandpaper be rigid. As wear occurs, tracking needs to be adjusted.

Any kind of fluid cooling of the abrading area is non-existent. The only cooling available would be a vacuum-type attachment to remove sawdust. A side-mounted vacuum or discharge results in an obstruction that limits ease of use for right-handed or left-handed users depending on which side the discharge is located.

In summary, existing belt sanders are found to be deficient in the following areas:

(a) Above average price tag, (b) Cost of belt sandpaper is expensive, (c) Bulky with poor visibility of abrading area, (d) Inability to finely adjust pressure at abrading area, (e) No flexibility in tool configuration, (f) Cannot change travel direction of sanding belt, (g) Limited ability to conform to contours, (h) Belt tracking breaks down as wear occurs, (i) Heat production at contact area breaks down abrading material, and (j) Discharge or vacuum attachments can limit ease of use by right-handed or left-handed persons.

OBJECTS AND ADVANTAGES

Accordingly, besides the objects and advantages of the drum sander attachment described in my above patent, several objects and advantages of my invention are:

(a) to provide a sander attachment that permits the utilization of abrasive material such as sandpaper in the most basic and least expensive form, that is, in the form of conventional, standard-size, rectangular, flat sheets which are low cost and easily available rather than sanding belts and preformed drums which are more expensive and can be difficult to find;

(b) to provide a sander attachment with the ability to change configuration of the tool to meet the needs of the user without having to purchase multiple tools;

(c) to provide a sander attachment that allows the option of hand-held operation or to be mounted in various positions;

(d) to provide a sander attachment that may be used by right-handed and left-handed persons with equal ease;

(e) to provide a sander attachment that allows the greatest ability to view the area being abraded with maximum ease of handling and control;

(f) to provide a sander attachment that permits the use of multiple drum container sizes to produce a variety of speeds and sander widths with a single tool;

(g) to provide a sander attachment which allows for a drum container which may be filled with a fluid, gas, or solid material to regulate drum firmness and weight;

(h) to provide a sander attachment which allows for a fluid-filled drum container to absorb heat produced by friction from the abrading operation, extending the useful life of the abrading material; and (i) to provide a sander attachment which allows for the recycling of plastic containers to an innovative and useful tool.

Further objects and advantages are to provide a sander attachment which can reverse directions of sandpaper travel, work equally well on flat or curved surfaces, provide the ability to change power units to suit the task, adapt for other finishing operations such as buffing and polishing, and provide adaptability to a variety of non-finishing related purposes such as the stirring of paint and the rolling up of rope, string, or wire. Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

Figure 1:
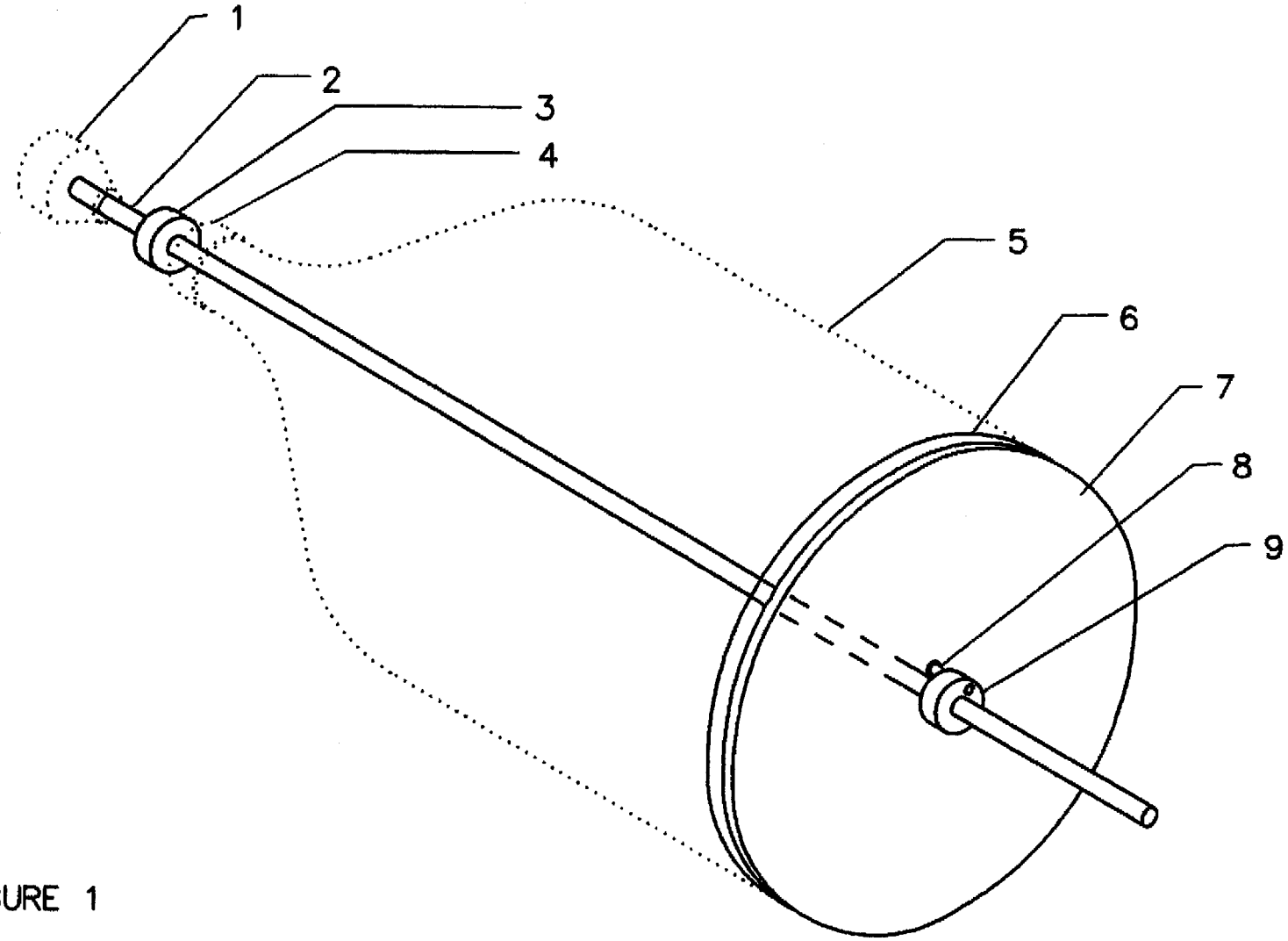
FIG. 1 shows an abrading device for holding a recycled container mounted on a shaft with drive means in place.

50 recycled container
51 power source
52 electric drill
54 shaft
54A shaft with hollow core
56 positioning collar
58 handle
59 handle inset
60 cap
62 nipple nut
64 washer
66 threaded nipple
66A threaded nipple with tightening notches
66B fabricated sealing nipple
68 sealing washer
70 "O" ring
71 groove
72 sleeved knob
73 flange
74 drive collar with pin hole
74A drive collar with protruding flange
74B split ring drive collar
76 engaging pin
78 drive plate with engaging hole
80 drive pad
82 threaded drive foot
83 bolt hole
84 drive foot bolt
88 formed drive plate
90 drive pin
92 engaging ring
94 drive plate with non-circular center
96 non-circular drive collar
97 attaching appendage
98 drive finger
100 drive socket with engaging hole 101 engaging flange
102 neck ring engaging slot
104 adapting insert-reducing
104A adapting insert-enlarging
106 set screw
108 protruding flange
110 motion transmission medium
112 container mounted valve
114 shaft mounted valve
115 exit port
116 slotted mounting bracket A
116A slotted mounting bracket B
120 base mounting bolt
122 column mounting bolt
124 mounting bushing

DESCRIPTION—FIGS. 1, 2, 4

The embodiment illustrated in FIG. 1 comprises; a suitable, unbreakable, impact-resistant, new or recycled container 50 (plastic soda bottle, bleach bottle, fabricated container, etc.) having holes drilled in the centers of the bottom surface and flat side of a cap 60 of sufficient size to allow access for the sealing means and a shaft 54.

A drive pad assembly (FIG. 4) is mounted on shaft 54. An engaging pin 76 is inserted and secured in a drive collar with pin hole 74 so that the protruding portion of engaging pin 76 extends only on the side toward recycled container 50. A drive plate with engaging hole, slot, opening, or aperture 78 is positioned next to drive collar 74 with engaging pin 76 mating with corresponding hole in drive plate 78. This is not to preclude a single piece incorporating drive collar and drive plate. Drive plate 78 is adhered to a drive pad 80 on the side toward recycled container 50. Drive pad 80 possesses a high coefficient of friction to produce a positive contact and direct relationship of rotation with recycled container 50. Drive pad 80 has a hole in the center of sufficient size to prevent contact with the sealing means of recycled container 50.

Figure 2:
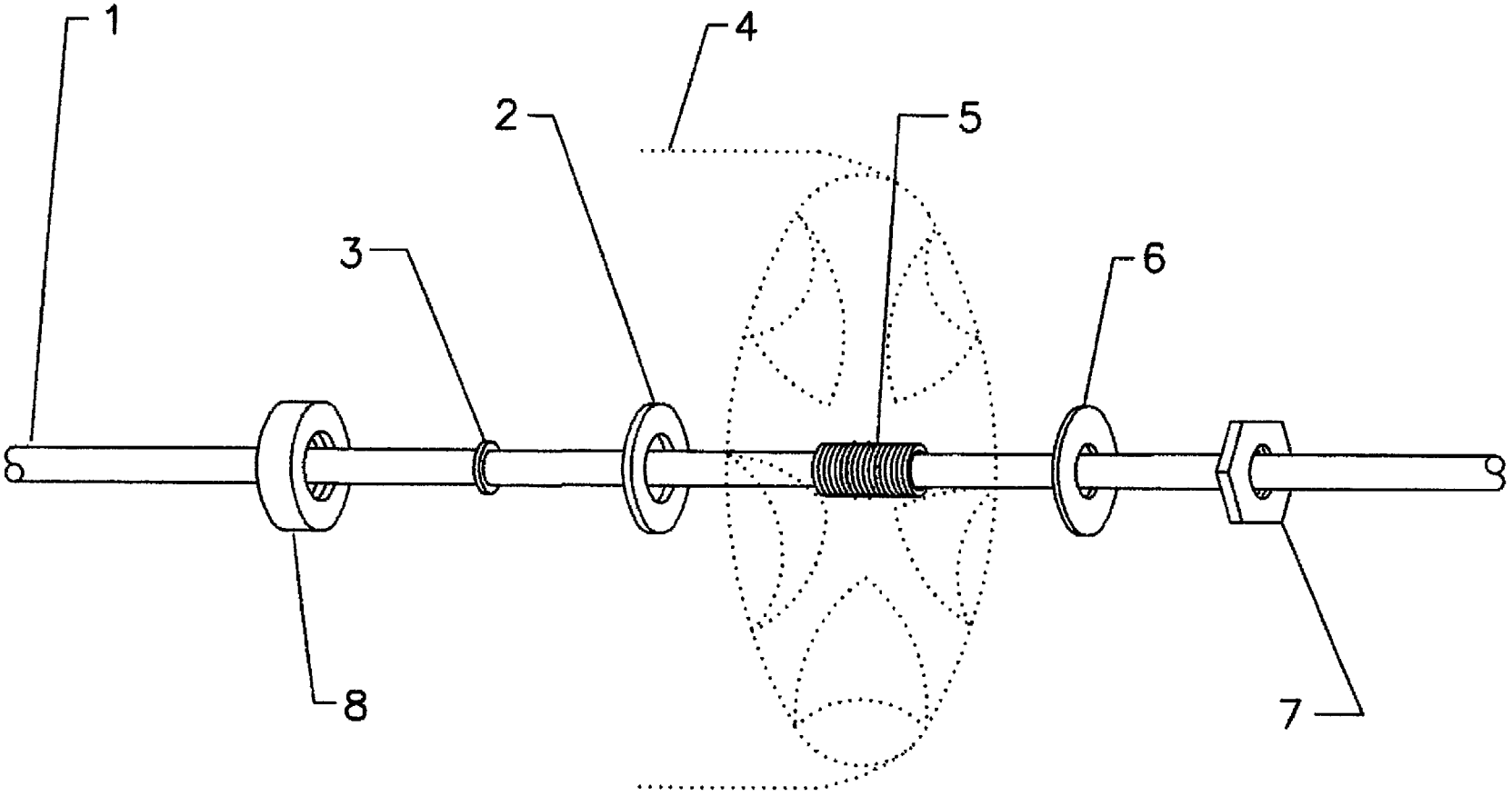
FIGS. 2 to 2D show various means for sealing the recycled container when mounted on a shaft.

The sealing means used for the bottom surface of recycled container 50 is illustrated in FIG. 2. The sealing means used in the flat side of cap 60 is shown in FIG. 2D. The holes are of sufficient size to allow a threaded nipple 66 to penetrate the wall of recycled container 50 with sufficient length to protrude from both sides, while having an interior diameter of sufficient size to allow shaft 54 to pass completely through. From the container wall, proceeding along threaded nipple 66 toward the interior of recycled container 50, a sealing washer 68 is positioned next to the interior wall of recycled container 50. Sealing washer 68 requires an internal diameter necessary to accept threaded nipple 66 and an external diameter of sufficient size to allow entry to the internal area through the neck of recycled container 50. An "O" ring 70 having an interior diameter of sufficient size to accept shaft 54 is located on shaft 54 next to and touching the interior end of threaded nipple 66 while having a diameter of sufficient size to meet, but not exceed, the thread height of threaded nipple 66. A sleeved knob 72 is positioned on shaft 54 with the threaded side toward and engaging threaded nipple 66 while trapping "O" ring 70 between the interior sleeved side of sleeved knob 72 and the end of threaded nipple 66. Sleeved knob 72, as detailed in FIG. 2B, has a sufficient diameter to allow entrance through the neck of recycled container 50 while providing a backer of equal size to sealing washer 68.

From the outside of recycled container 50, proceeding along threaded nipple 66, a washer 64 is positioned on threaded nipple 66 and against the wall of recycled container 50. Washer 64 has an internal diameter of sufficient size to allow threaded nipple 66 to pass and an external diameter equal to that of sealing washer 68 positioned on the opposite side of recycled container 50. A nipple nut 62 is positioned next to and against washer 64. Nipple nut 62 is of sufficient size to engage the threads of threaded nipple 66 with a diameter equal to or less than washer 64.

Referring to FIG. 1, positioned on shaft 54 next to and against the exterior end of threaded nipple 66 used in the sealing means of the cap (FIG. 2D) is a positioning collar 56. At the end of shaft 54 attach a power source or motor device 51, the most common being an electric drill 52.

OTHER EMBODIMENTS—FIGS. 2 to 8

Further embodiments are illustrated in FIGS. 2 to 8 and are described as follows.

Figure 2A:
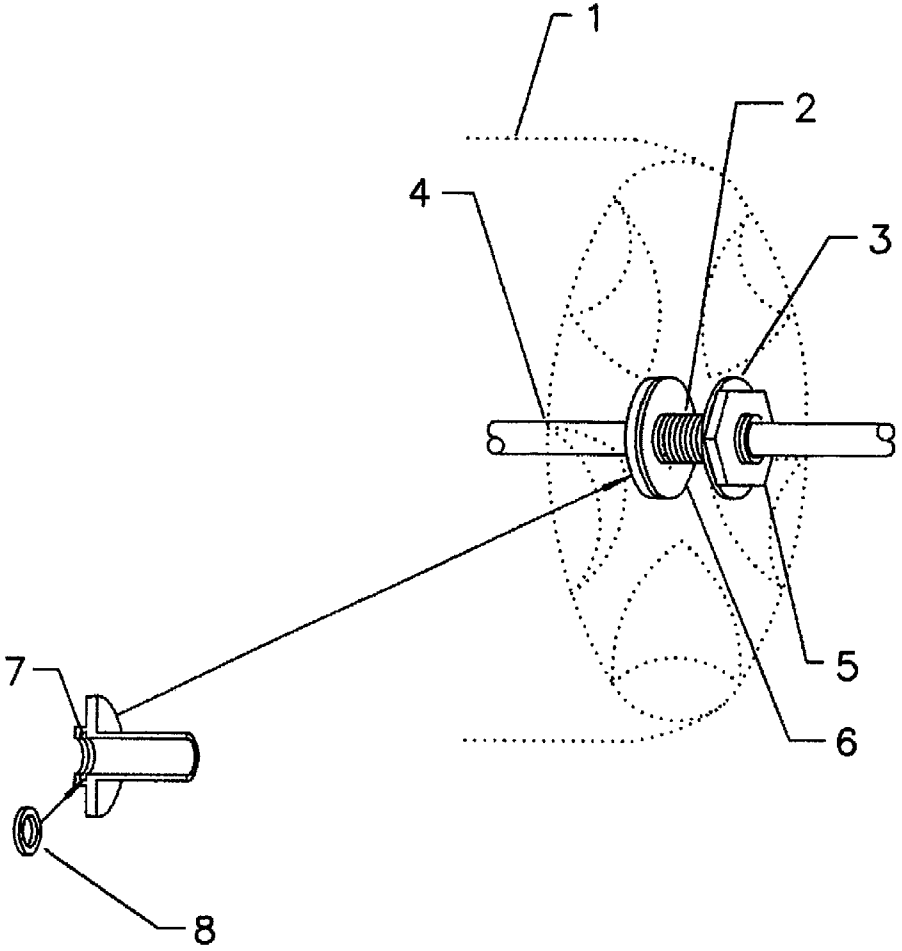

FIG. 2A shows a fabricated sealing nipple 66B having a groove 71 located on the inside of the tube near the end which is installed within recycled container 50. "O" ring 70 is positioned within groove 71. Proceeding on the outer surface of sealing nipple 66B, fabricated as a single piece with sealing nipple 66B, is a flange 73 protruding at a perpendicular radius from sealing nipple 66B. The diameter of flange 73 is less than the opening of the neck of recycled container 50. Located against and having approximately the same external diameter as flange 73 is sealing washer 68. Recycled container 50 has a hole of sufficient size to allow sealing nipple 66B to pass while positioning sealing washer 68 against recycled container 50. Positioned on the outside and against recycled container 50 on sealing nipple 66B is washer 64. Next to and against washer 64 and engaging sealing nipple 66B is nipple nut 62.

Figure 2C:
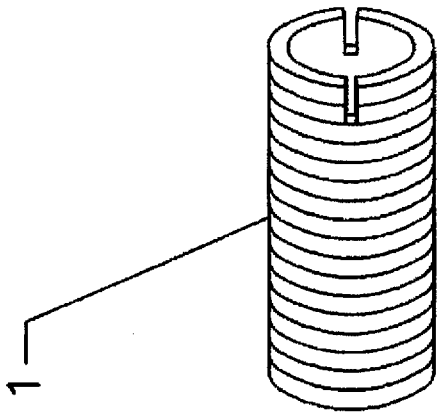

In FIG. 2C, a threaded nipple with tightening notches 66A allows for the tightening of nipple nut 62 while threaded nipple 66A protrudes through the recycled container 50 wall.

Figure 3A:
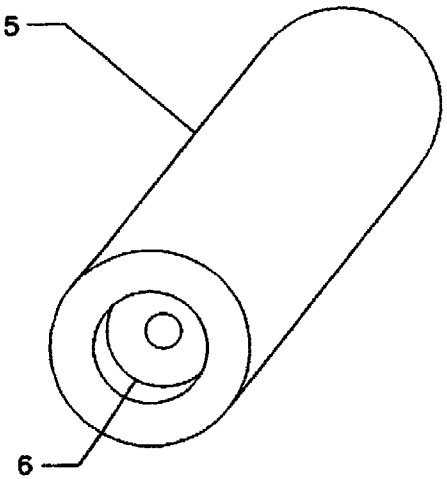
FIGS. 3 to 3E show the versatility of tool configurations in various embodiments.
Figure 3:
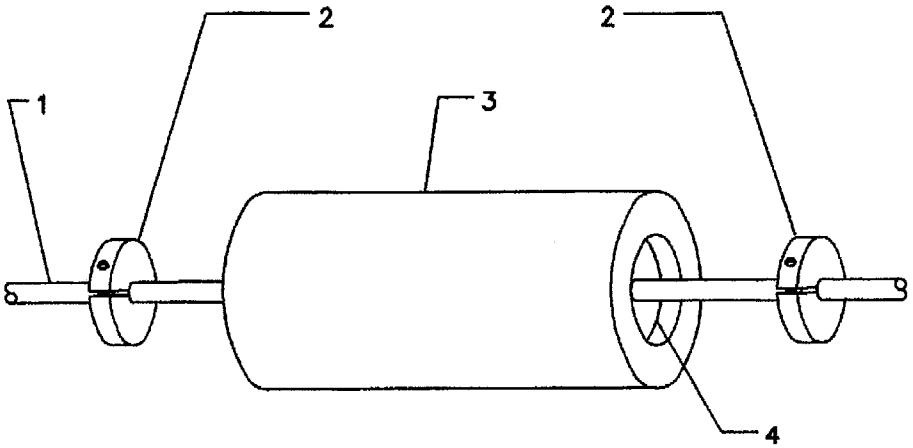

In FIG. 3, a handle 58 surrounds the diameter of shaft 54. Handle 58 is held in place by positioning collar 56. Two collars are used, one on either side of handle 58. One collar resides within a handle inset 59 as shown in FIG. 3A. Handle 58, when mounted next to drive collar 74, must leave a gap having a space of at least the width of positioning collar 56 separating drive collar 74 and the closest positioning collar 56 of the handle assembly.

Figure 3B:
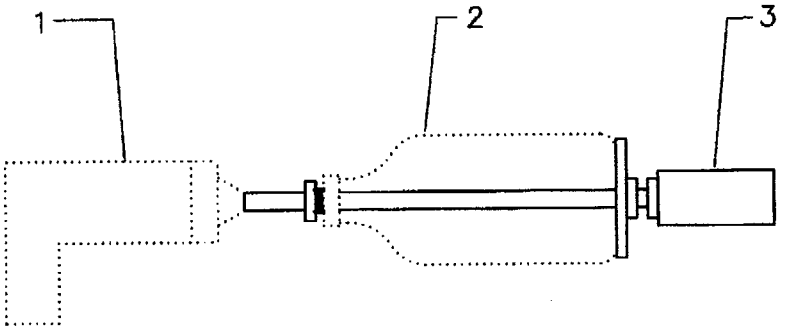

FIG. 3B shows the abrading device mounted rolling pin style in which recycled container 50 is positioned on shaft 54 between handle 58 and electric drill 52.

Figure 3C:
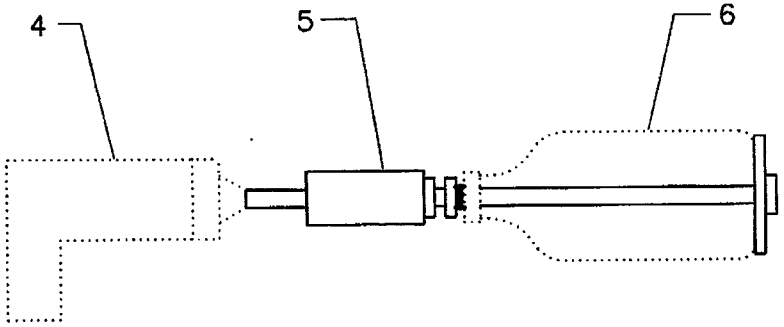

FIG. 3C shows the abrading device mounted wand style with recycled container 50 positioned on one end of shaft 54, with electric drill 52 on the opposite end of shaft 54 and handle 58 positioned between recycled container 50 and electric drill 52.

Figure 3D:
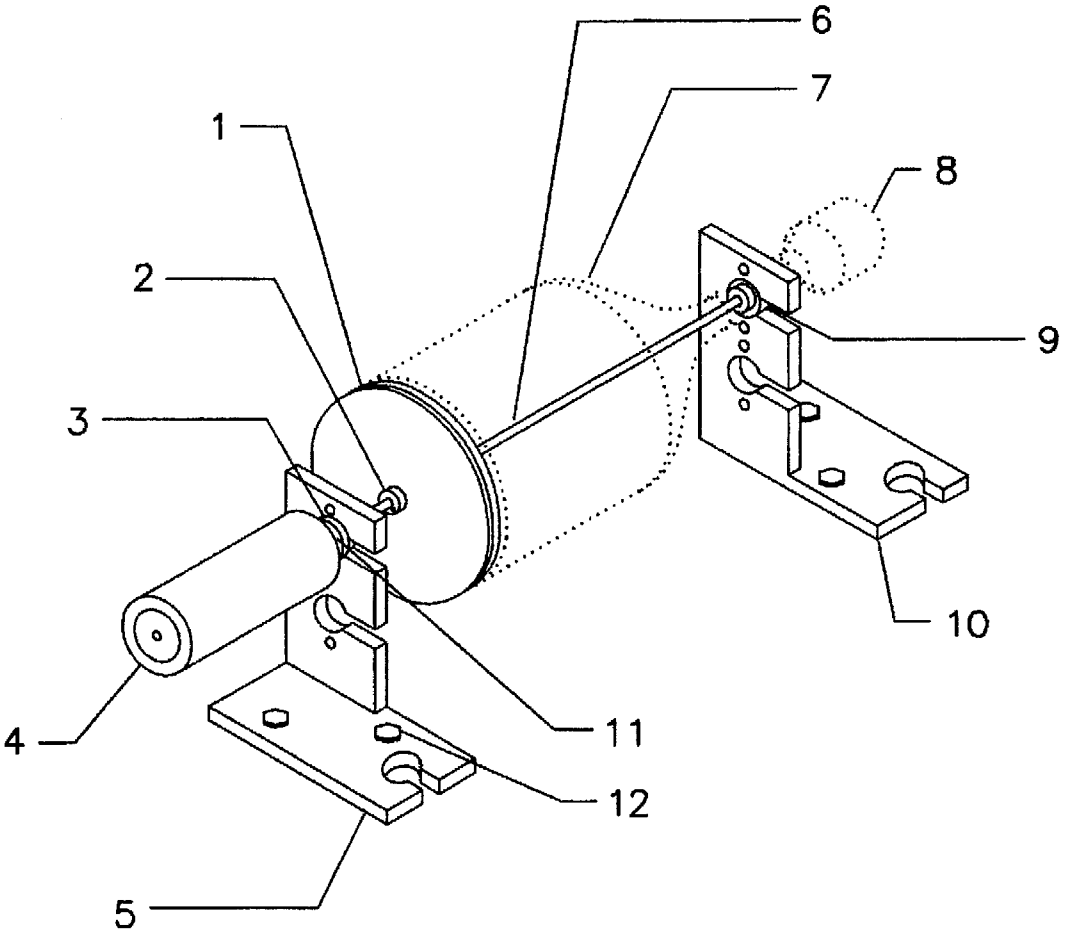

FIG. 3D shows the abrading device mounted in a horizontal position. Shaft 54 is positioned within a slotted mounting bracket A 116 and a slotted mounting bracket B 116A which are secured to an appropriate base (table, bench, etc.) with a base mounting bolt 120. A mounting bushing 124 is positioned within each bracket in a slotted entry hole located on the vertical column. Positioning collar 56 is placed next to mounting bushing 124.

Figure 3E:
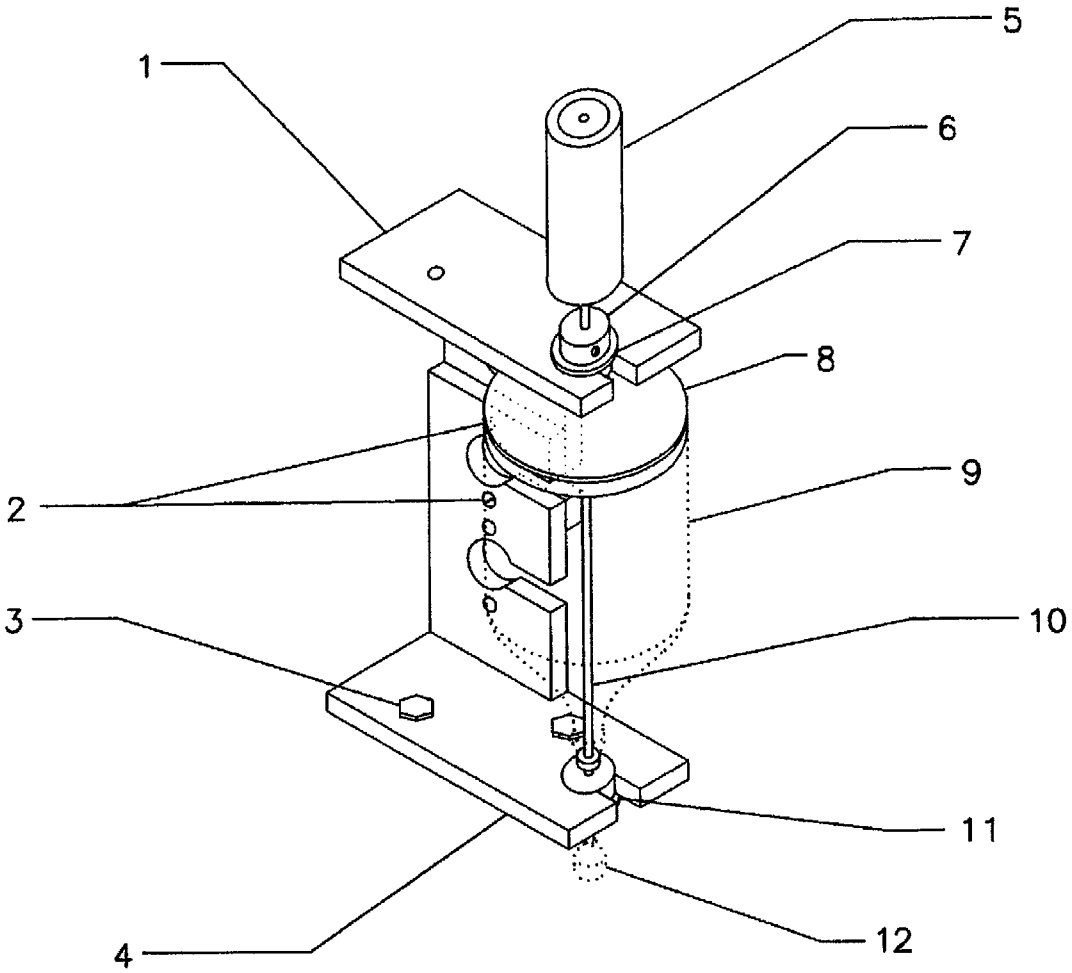

FIG. 3E shows a stationary mount for holding the abrading tool in a vertical position. Slotted mounting bracket B 116A is attached by a column mounting bolt 122 to slotted mounting bracket A 116 in a vertical, inverted position with the slotted toe forward. The slotted toe of slotted mounting bracket B 116A is aligned with the slotted toe in slotted mounting bracket A 116. The hole in the toe of slotted mounting bracket B 116A is positioned off-center by the width of the vertical portion of slotted mounting bracket B 116A. When slotted mounting bracket B 116A is affixed to slotted mounting bracket A 116, the slotted holes align. Shaft 54 is held vertically in the aligned holes by mounting bushings 124 and secured by positioning collar 56.

Figure 4:
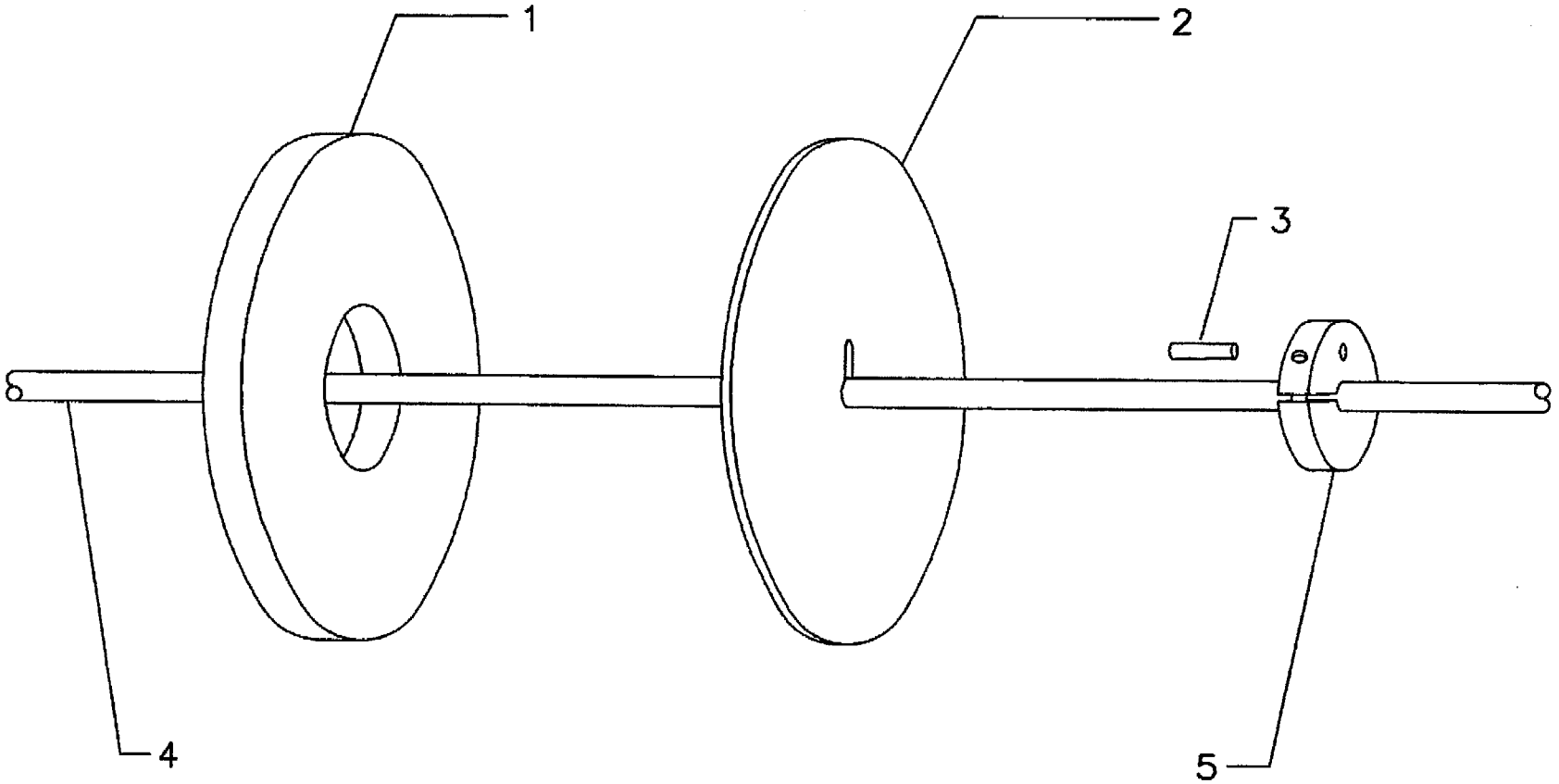
FIGS. 4 to 4F show various means for engaging a drive plate for rotating the recycled container.
Figure 4A:
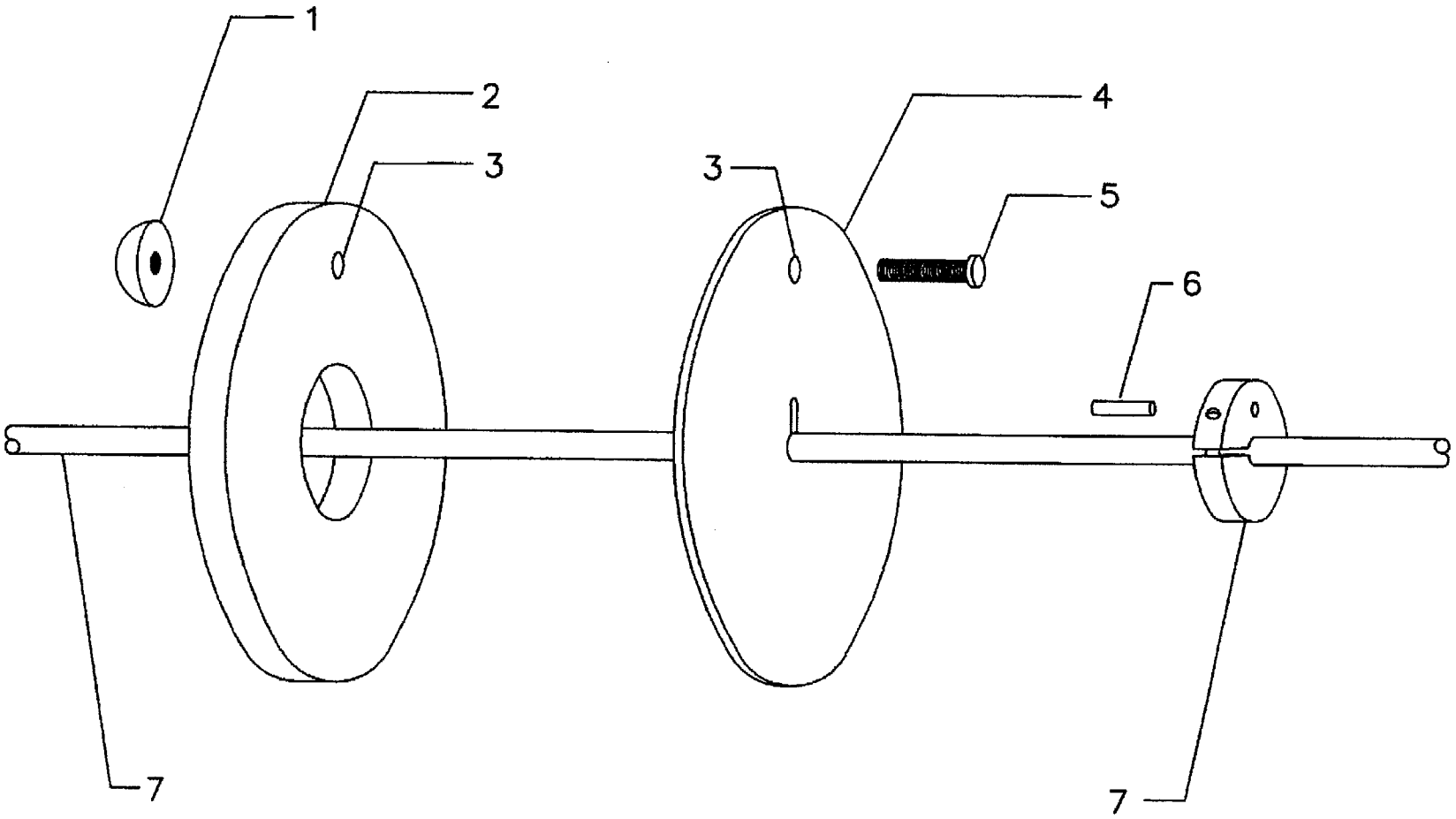

In FIG. 4A a corresponding bolt hole 83 in drive plate 78 and drive pad 80 is located in such a way that it will allow for positioning within any convolution in the bottom surface of recycled container 50. A threaded drive foot 82 is positioned on the surface of drive pad 80 at bolt hole 83 which engages the contoured bottom surface of recycled container 50. A drive foot bolt 84 is of sufficient length to pass through drive plate 78, drive pad 80, and be engaged by threaded drive foot 82.

Figure 4B:
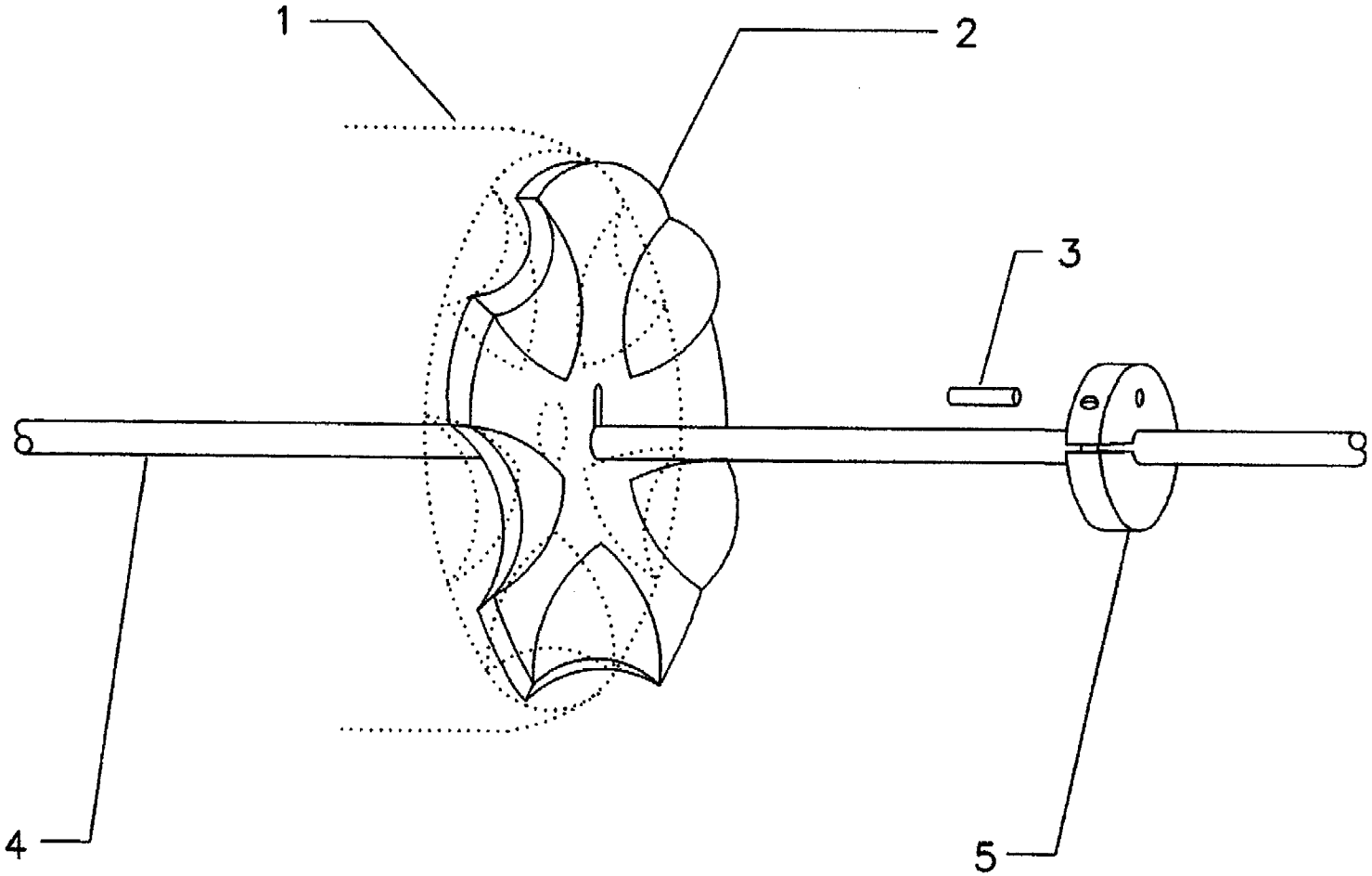

FIG. 4B shows a formed drive plate 88 designed to mate with the contacted surface of recycled container 50.

Figure 4C:
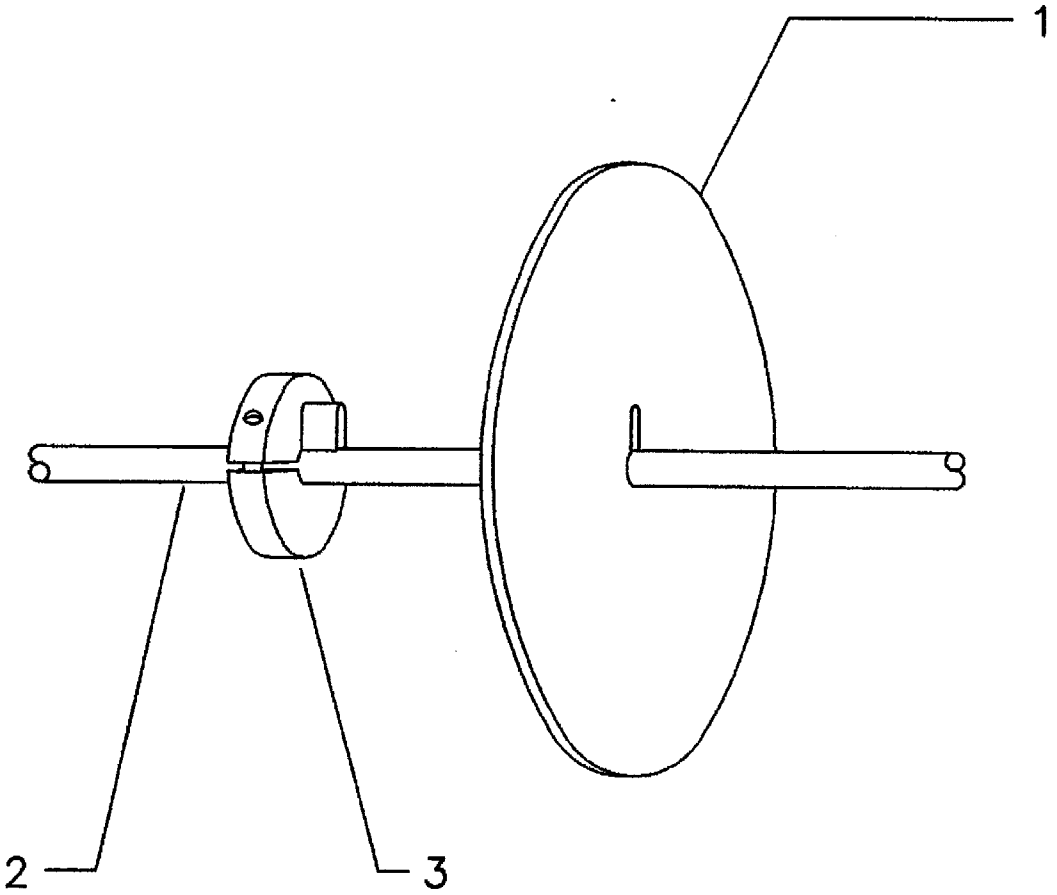

FIG. 4C illustrates a drive collar with protruding flange 74A mating with drive plate with engaging hole 78.

Figure 4D:
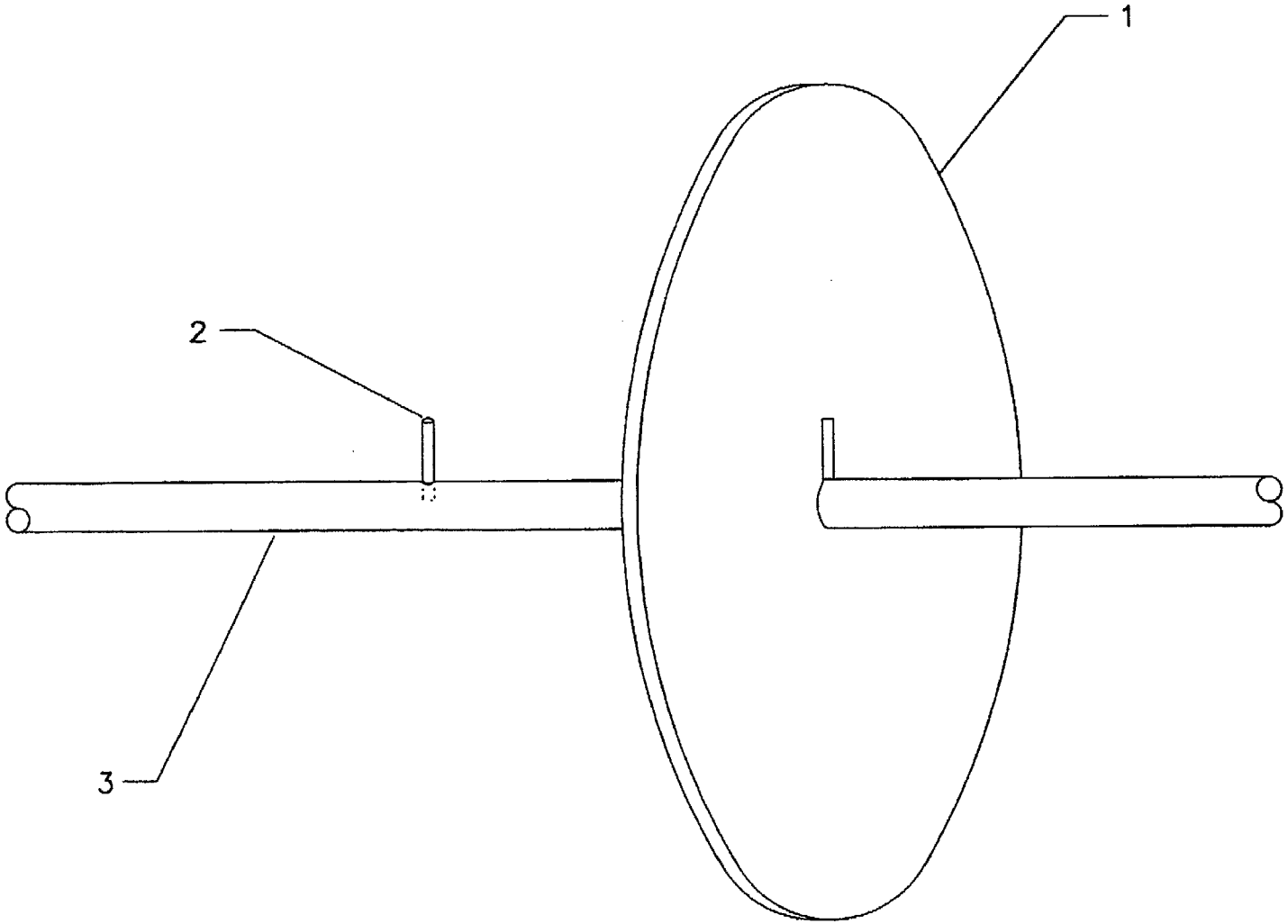

FIG. 4D shows a drive pin 90 secured to shaft 54. Drive pin 90 is designed to mate with the engaging hole of drive plate 78.

Figure 4E:
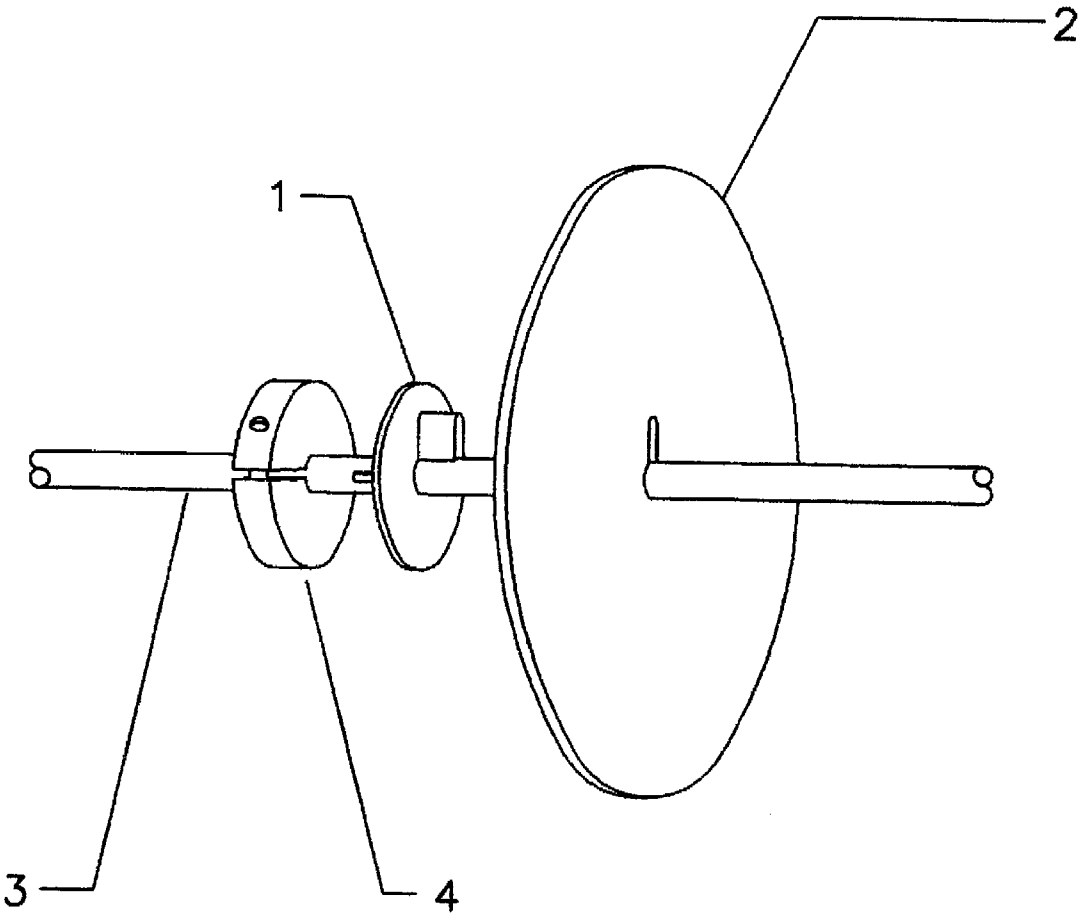

In FIG. 4E a drive collar 74B of split ring design contacts and mates with an engaging ring 92 having perpendicular flanges corresponding to the slots and contours in engaging ring 92. On engaging ring 92 surface contacting drive plate 78 are perpendicular flanges protruding from engaging ring 92 and mating with the engaging hole of drive plate 78.

Figure 4F:
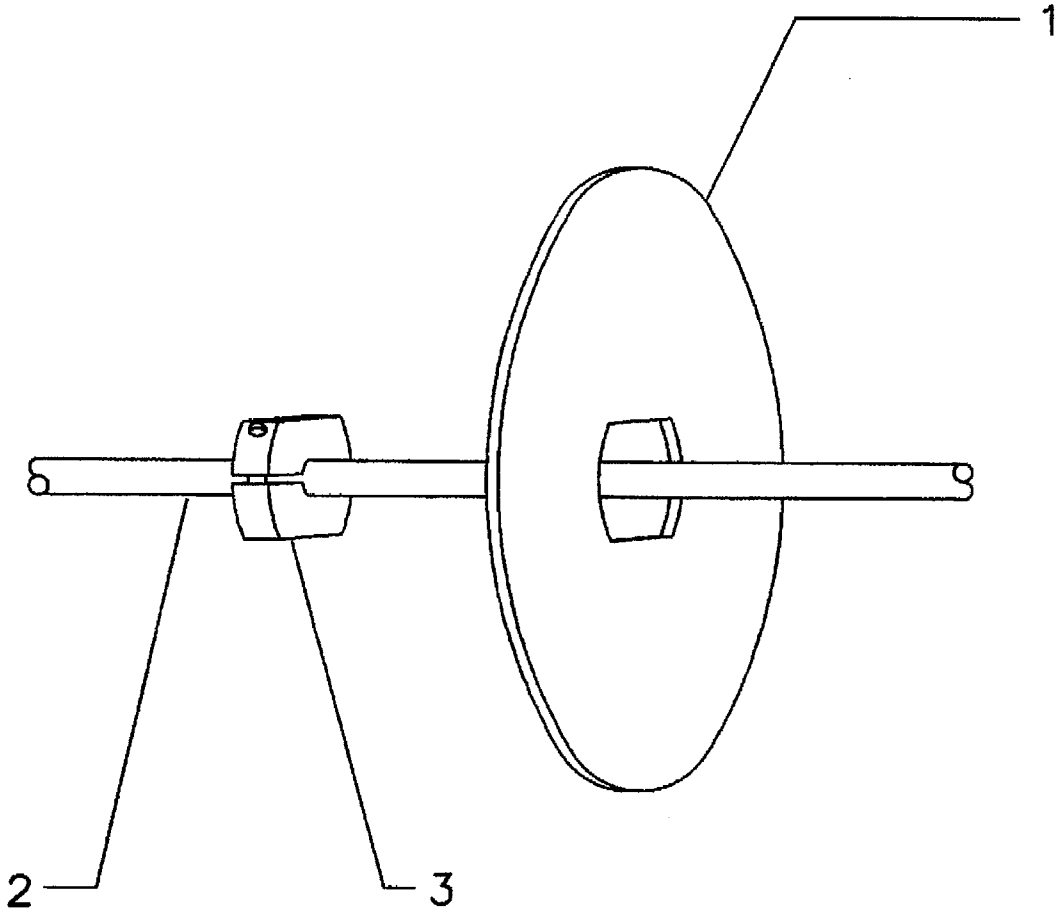

FIG. 4F shows a non-circular drive collar 96 mating with a drive plate 94 having a center hole of corresponding shape.

Figure 5:
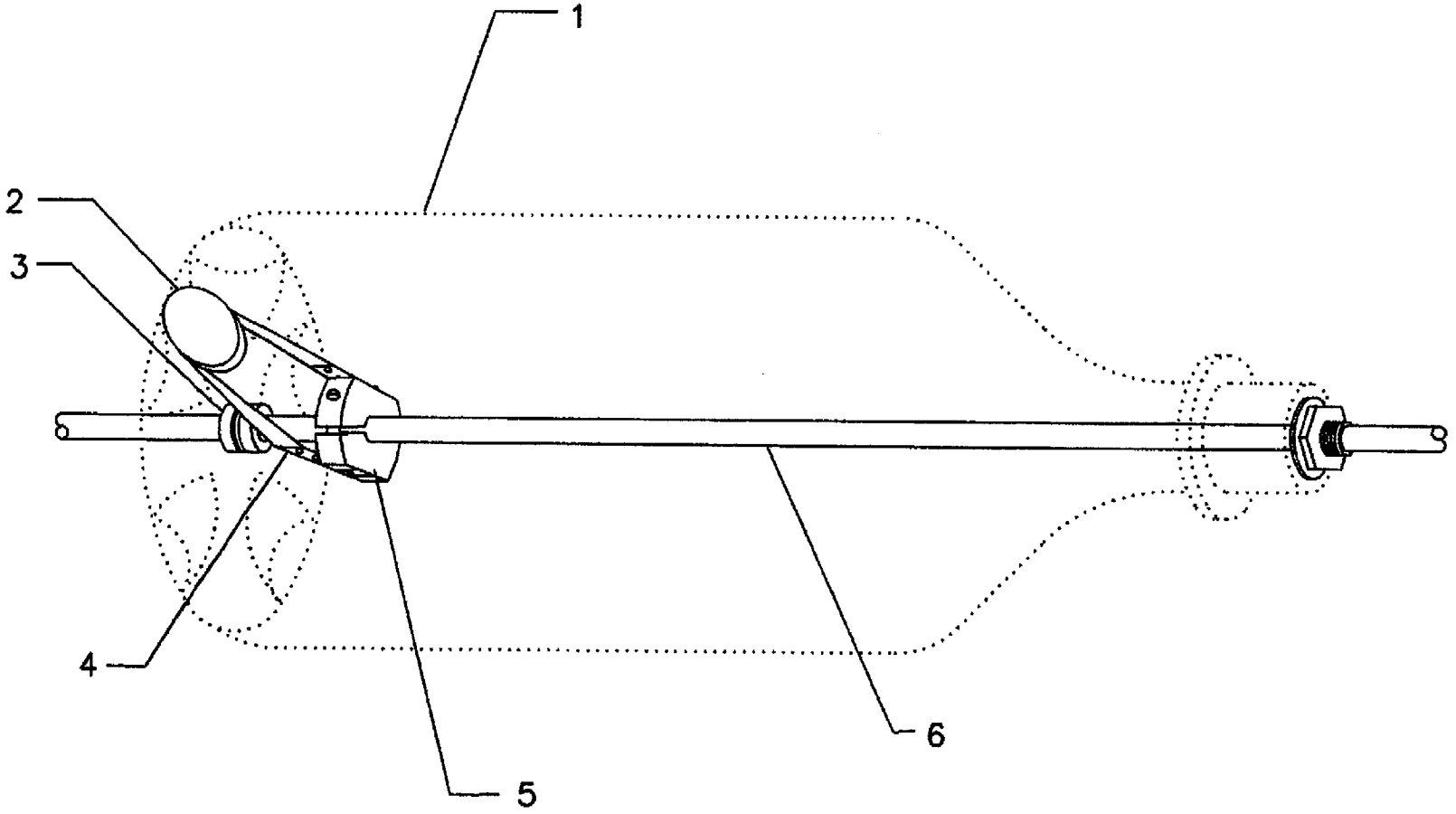
FIG. 5 shows an internal drive for rotating a recycled container utilizing a contoured surface of the container.

FIG. 5 shows non-circular drive collar 96 of sufficient size and shape to allow entrance to the interior of recycled container 50 with a drive finger 98 attached. A circular drive collar may be used, provided entrance to the interior of recycled container 50 can be accomplished with drive finger 98 attached. Drive finger 98 engages recycled container 50 in the same manner as drive foot 82 when installed within the interior of recycled container 50. Drive finger 98 is attached to drive collar 96. An attaching appendage 97 allows drive finger 98 to swing. The length of drive finger 98 adjusts to various recycled container diameters by selecting the appropriate hole series in attaching appendage 97.

Figure 6:
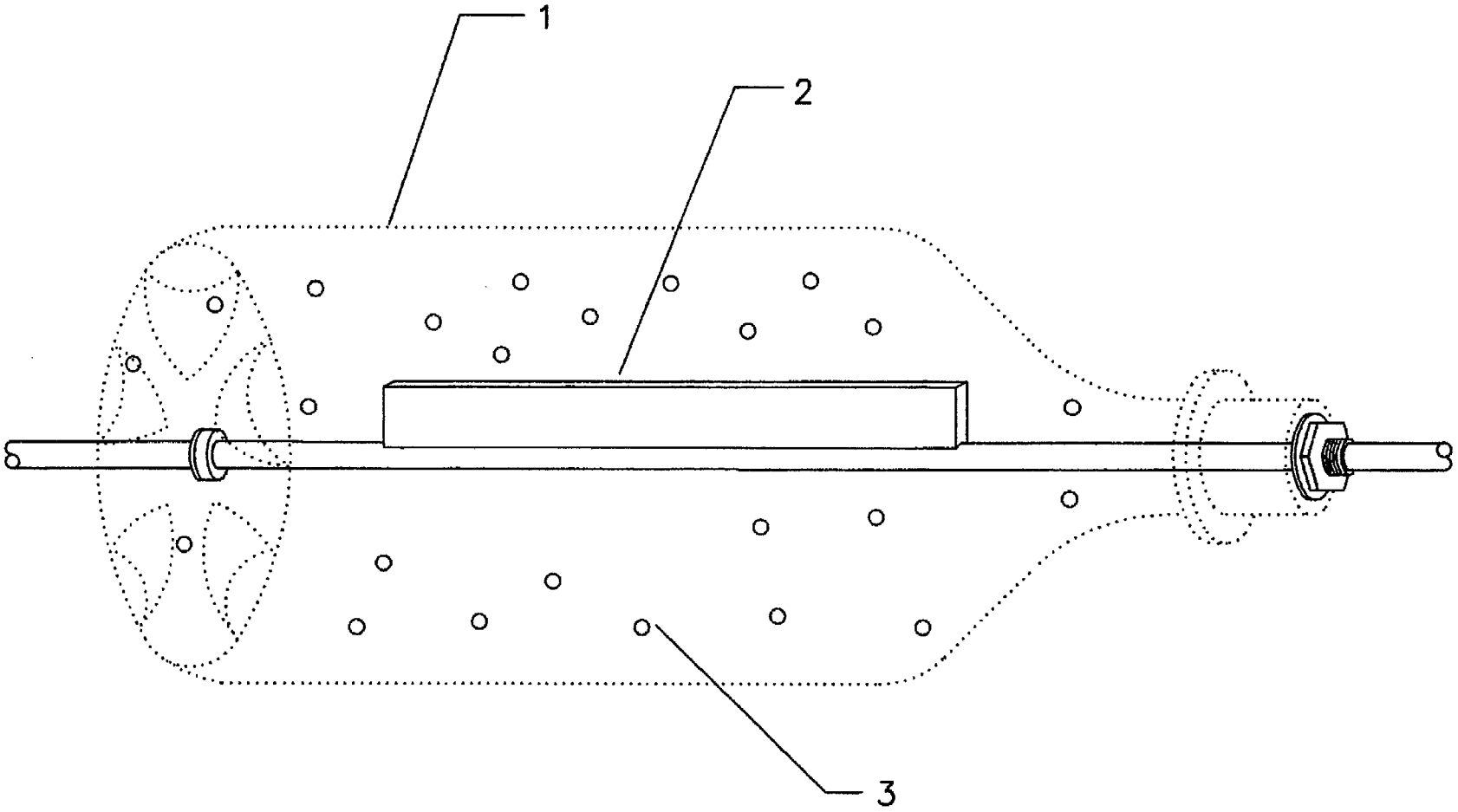
FIG. 6 shows an internal drive for rotating a recycled container utilizing a motion transmission medium within the container.

In FIG. 6 a (fixed or removable) internal protruding flange 108 in single or multiple mountings projects in a radical manner from a fixed position on shaft 54. The diameter of protruding flange 108 and shaft 54 in combination is less than the opening in the neck of recycled container 50. With sealing means (FIGS. 2 and 2D) in place, recycled container 50 is filled with a motion transmission medium 110 which can be any fluid, gas, or solid substance possessing the ability to transmit the motion of protruding flange 108 to recycled container 50.

Figure 7:
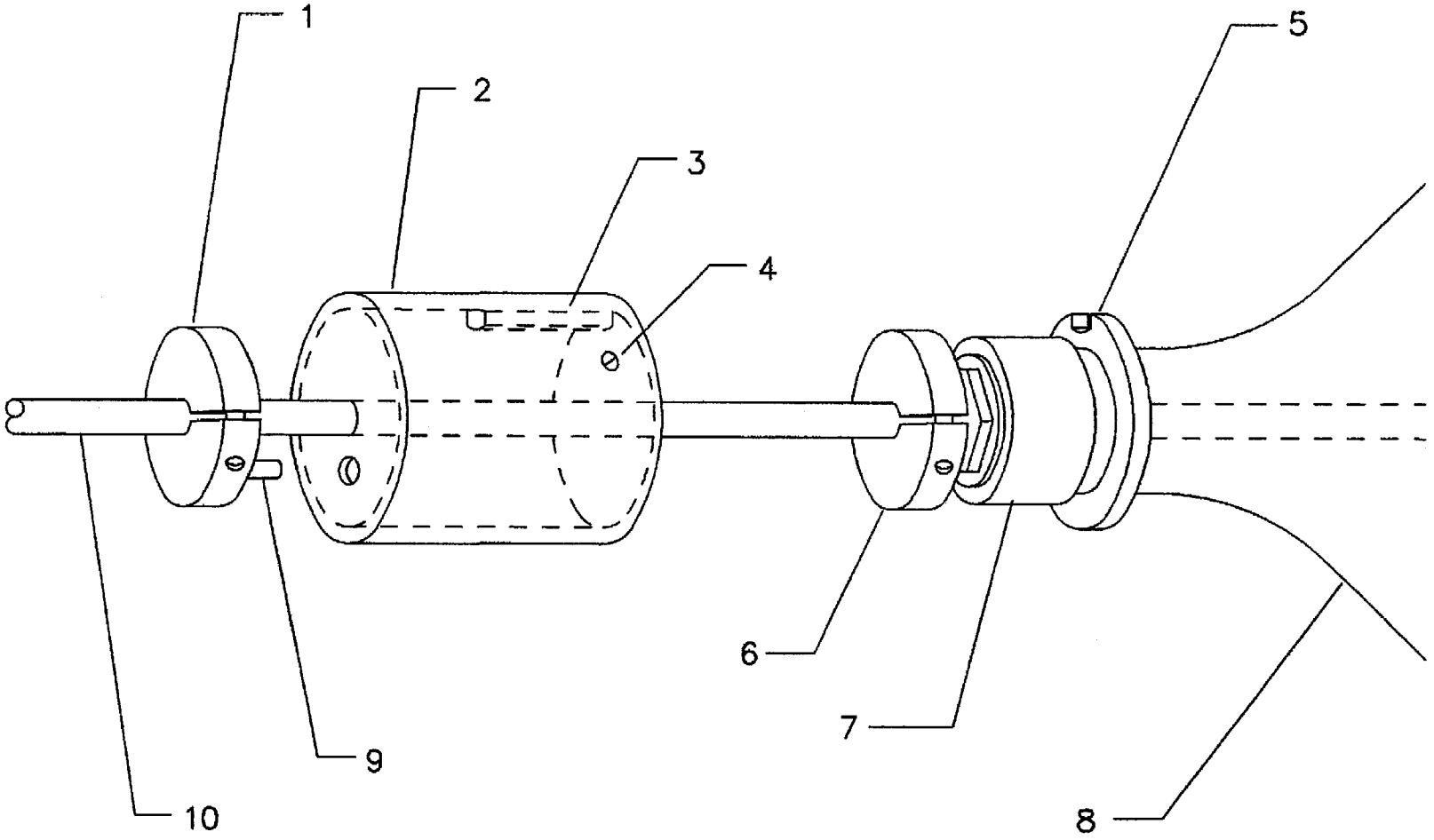
FIGS. 7 to 7B show a neck drive socket for rotating a recycled container.

FIG. 7 shows recycled container 50 having a ring encompassing and protruding outwardly from the neck area. The neck ring may be molded as part of recycled container 50 or a separate part affixed to the neck of recycled container 50 in a stationary manner. Positioning collar 56 is affixed next to the sealing means (FIGS. 2 and 2D) at both ends of recycled container 50. An engaging slot 102 is fabricated in the neck ring. The number, shape and location of engaging slot 102 would depend on the configuration of a drive socket with engaging hole 100 which mates with engaging slot 102. Drive socket 100 has a hole in the center of the cap-end of sufficient size to accept shaft 54. Located on the inside of the large open-end of drive socket 100 is an engaging flange 101. Engaging flange 101 protrudes at a radius generally inwardly from the socket sidewalls and extends to a depth in the socket cavity of sufficient degree and size to engage slot 102 located in the neck ring. Engaging pin 76 inserted in the engaging hole located in the cap-end of drive socket 100 mates with the pin hole in drive collar 74 located next to drive socket 100.

Figure 7A:
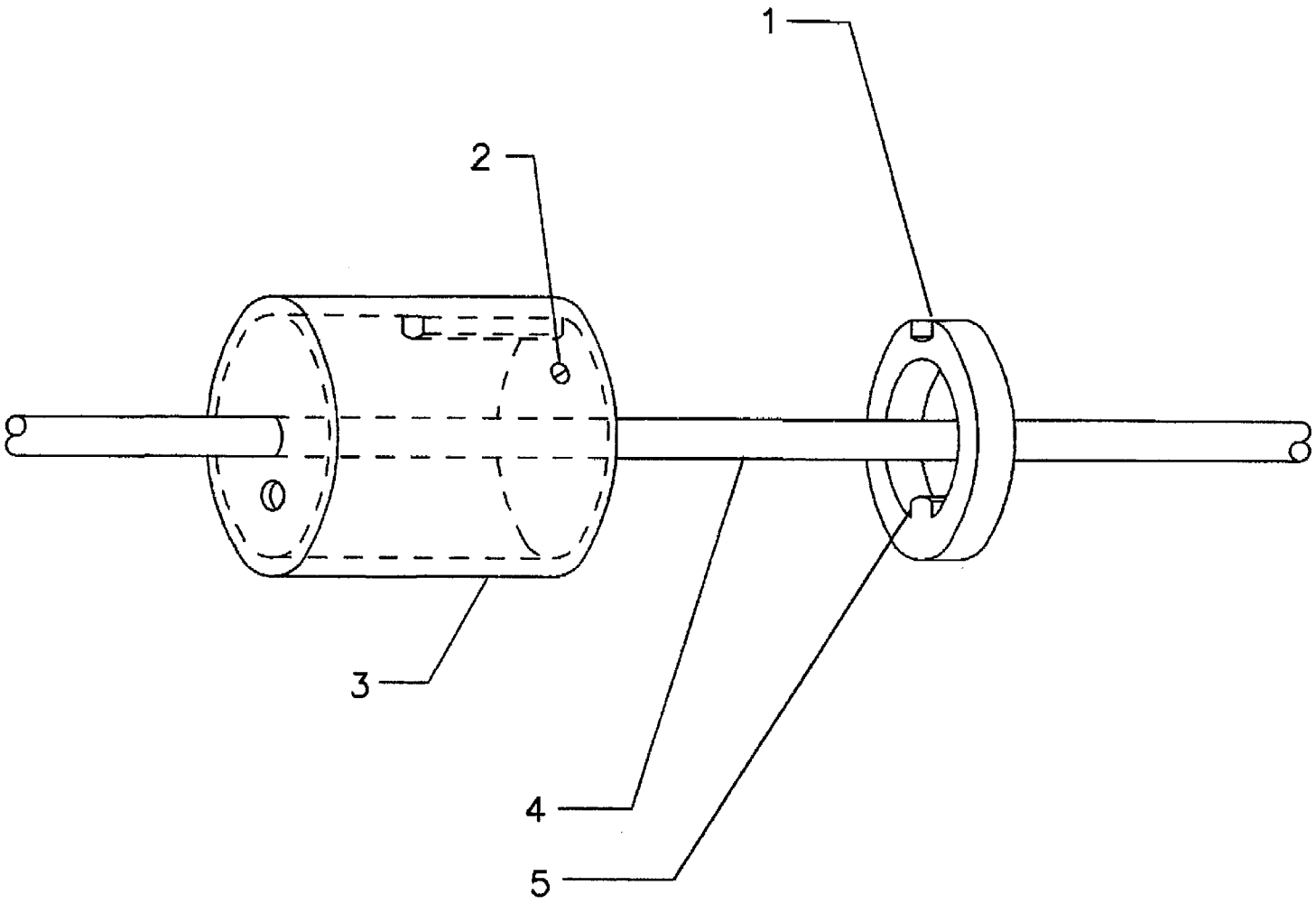
Figure 7B:
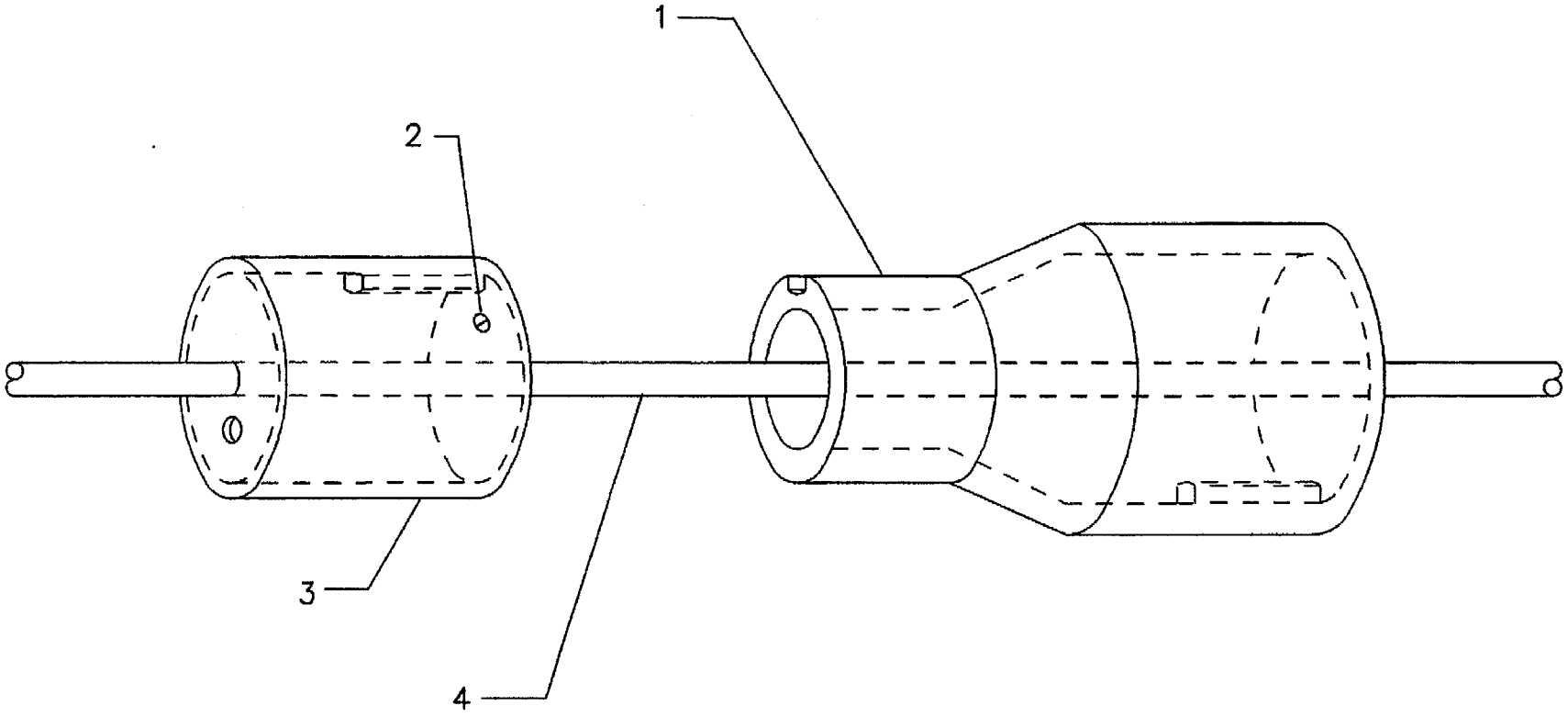

FIG. 7A shows an adapting insert for reducing 104 that mates with engaging flange 101 of drive socket 100 and aligns with a set screw 106. The protruding edge of adapting insert 104 is fabricated to mate with engaging slot 102 in the neck ring when the neck ring is a smaller diameter than drive socket 100 will accept. FIG. 7B shows an adapting insert for enlarging 104A for use when the neck ring is larger than drive socket 100 will accept and attaches in the same manner as described in affixing adapting insert 104.

Figure 8:
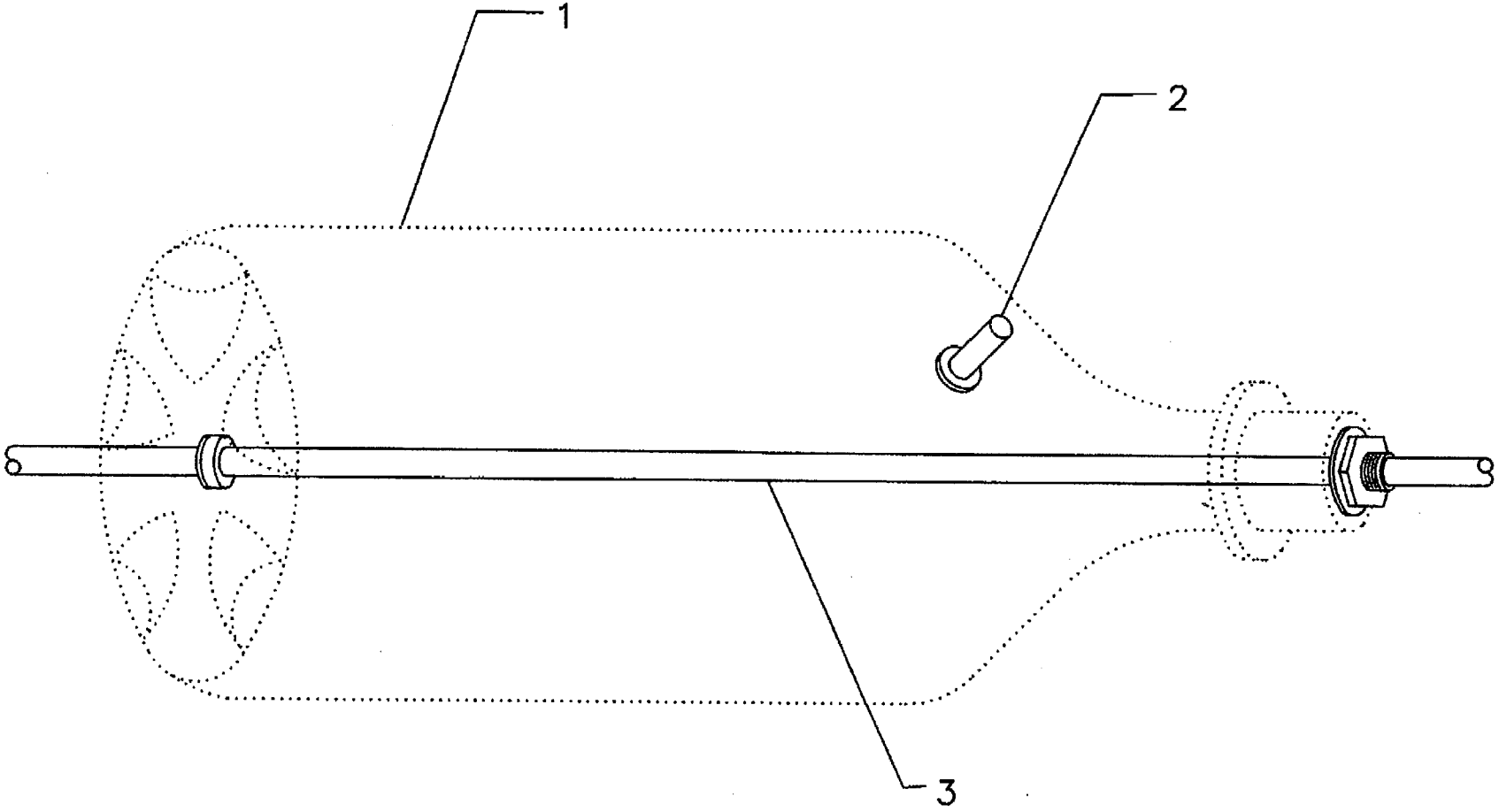
FIGS. 8 to 8A show a means of pressurizing or filling a recycled container to produce desired firmness or weight.

In FIG. 8 a container mounted valve 112 is attached at an appropriate location on recycled container 50. Valve 112, while sealing with the container wall or cap, should be positioned in such a manner so as not to interfere with the operation of the tool.

Figure 8A:
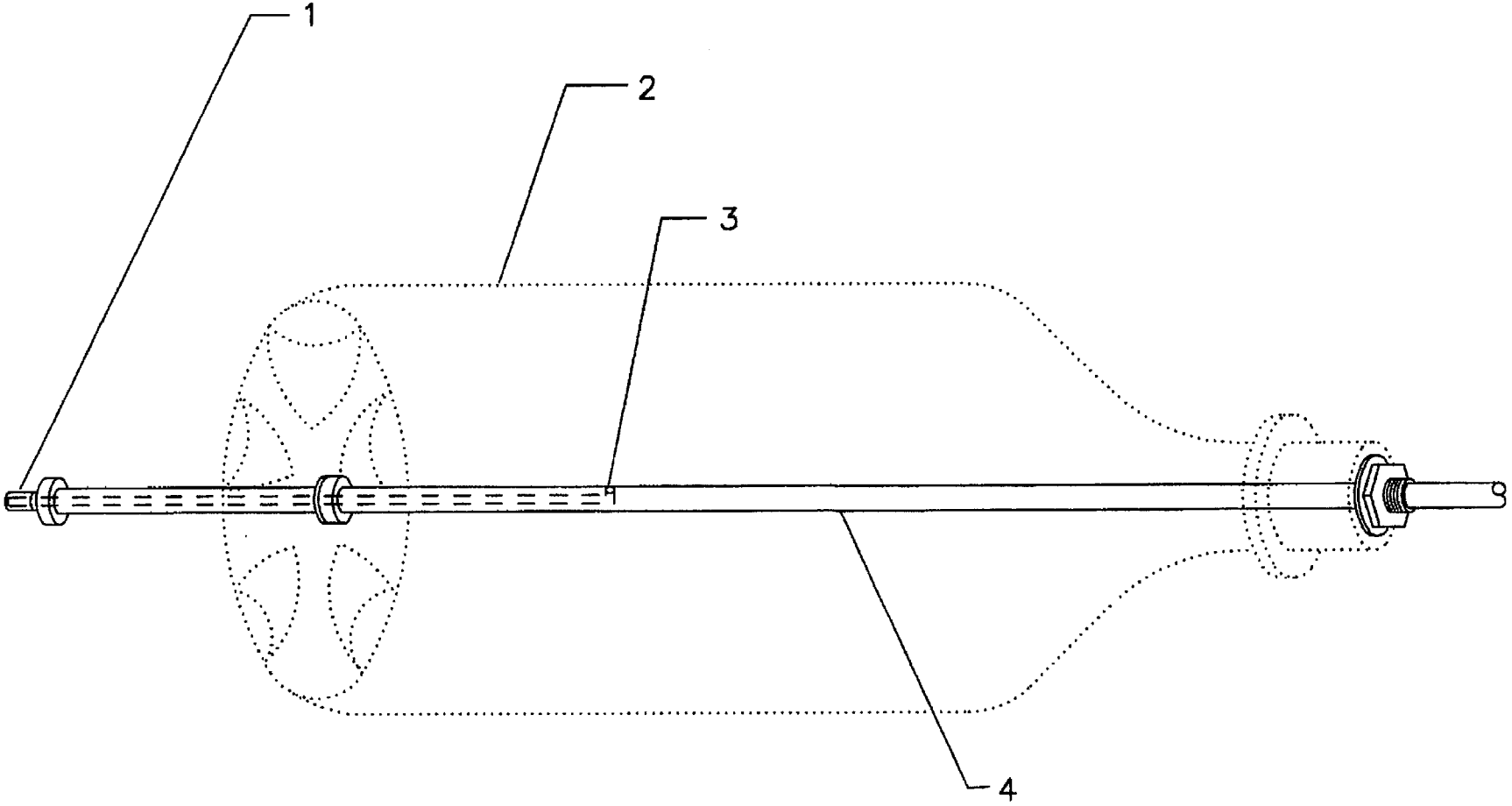

FIG. 8A shows a shaft mounted valve 114 installed at the end of a hollow shaft 54A having a hollowed core beginning at one end of shaft 54A and proceeding to the internal area of recycled container 50 where an exit port 115 is located. The hollow core of shaft 54A may extend a partial length or full length of the shaft, but must be sealed at the end opposite shaft mounted valve 114.

OPERATION-FIGS. 1, 2, 4

Figure 2B:
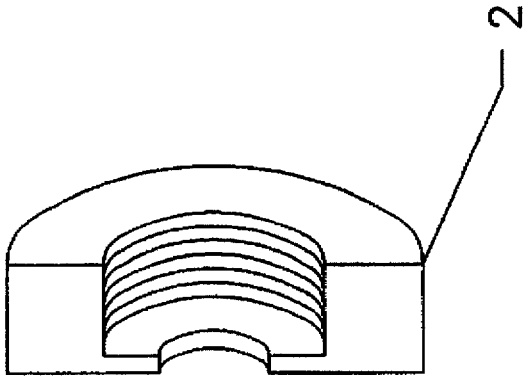
Figure 2D:
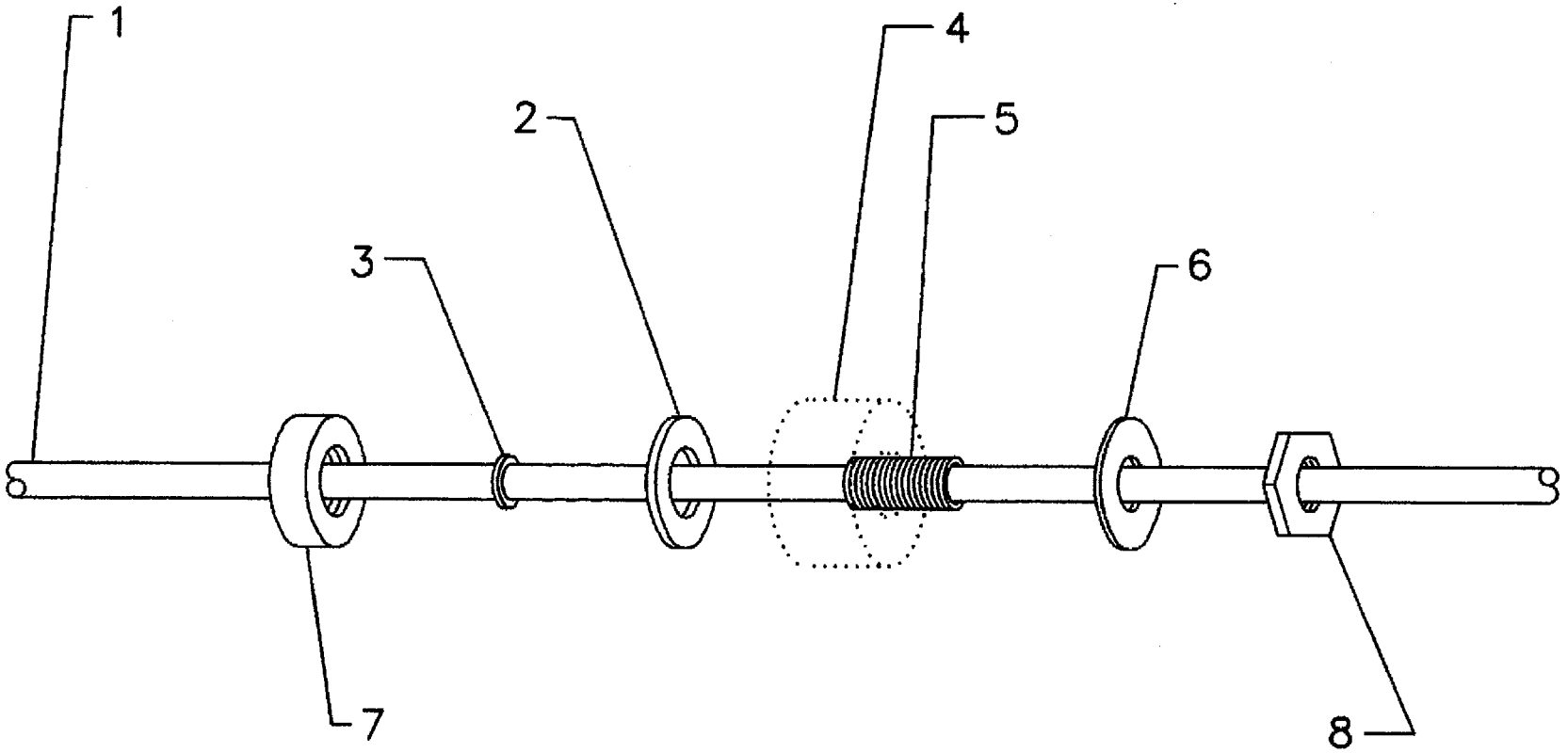

An appropriate recycled container 50 is selected. A hole of sufficient size to allow threaded nipple 66 to pass is drilled in the center of the flat side of cap 60 and the bottom surface of recycled container 50. These are the mounting points of recycled container 50 (FIG. 1). Place threaded nipple 66 on one end of shaft 54. Place "O" ring 70 on shaft 54 against threaded nipple 66. Fabricate sleeved knob 72 by drilling a hole of sufficient size for shaft 54 to pass through in the center of the cap of a solid knob end-piece (FIG. 2B). Place sleeved knob 72 on shaft 54 with the threads toward threaded nipple 66. When threaded nipple 66 is engaged and tightened against sleeved knob 72, "O" ring 70 is trapped between sleeved knob 72 and the end surface of threaded nipple 66. Sealing threaded nipple 66 prevents leakage between threaded nipple 66 and shaft 54. The seal produced is a dynamic seal which allows movement of the seal in respect to shaft 54 without failure. The sealing means (FIG. 2) is repositioned by sliding on shaft 54 toward and near the other end of shaft 54. Position sealing washer 68 on threaded nipple 66 against sleeved knob 72. With cap 60 of recycled container 50 removed, the sealing means (FIG. 2) is guided with threaded nipple 66 leading through the neck of recycled container 50 and passing through the hole in the bottom of recycled container 50. Stop when sealing washer 68 contacts the container bottom surface with the threads from threaded nipple 66 protruding through the bottom hole and exiting recycled container 50. Washer 64 is placed on threaded nipple 66 and next to recycled container 50. Nipple nut 62 is threaded on threaded nipple 66 and tightened against washer 64. This allows sealing washer 68 to produce a seal between sleeved knob 72 and the bottom surface of recycled container 50. This completes the sealing of the bottom mounting hole of recycled container 50. With the bottom sealing means (FIG. 2) in place, recycled container 50 is positioned near the middle of shaft 54. A second sealing means (FIG. 2D) is installed in cap 60 of recycled container 50. The installation of cap 60 sealing means (FIG. 2D) is simplified due to the ability to reach both sides of the sealing means (FIG. 2D) while assembling it on shaft 54. Cap 60 and sealing means (FIG. 2D) are positioned near, but not engaging the threads on the neck of recycled container 50. Fill recycled container 50 with an appropriate substance (water, air, sand, expanded foam, gel, sawdust, etc.) for desired firmness. Cap 60 with sealing means (FIG. 2D) in place engages the threads of recycled container 50 and is tightened. With recycled container 50 sealed, it is positioned at the desired location on shaft 54. At the bottom side of recycled container 50 the drive means (FIG. 4), formed by the bonding of drive plate with engaging hole 78 and drive pad 80, is positioned through the center holes on shaft 54, drive pad 80 contacting the bottom surface of recycled container 50. Drive pad 80 is of a material possessing a high co-efficient of friction capable of transferring the energy from drive plate 78 to recycled container 50.

The shaft engaging mechanism comprises drive collar 74 fabricated with engaging pin 76. Drive collar 74 is positioned next to drive plate 78 with engaging pin 76 mating with the engaging hole of drive plate 78. Drive collar 74 is tightened and holds position with respect to its location on and rotation of shaft 54.

Positioning collar 56 is placed on shaft 54 against the sealing means (FIG. 2D) installed in cap 60 of recycled container 50. Pressure is applied forcing the bottom surface of recycled container 50 against the drive means (FIG. 4). Positioning collar 56 is tightened on shaft 54, increasing the coefficient of friction factor between drive pad 80 and recycled container 50.

Shaft 54 is connected to power source or motor drive 51, the most common being electric drill 52. With this configuration, drill 52 would preferably have two handles for stability.

While not being addressed within the scope of this patent, the desired treatment medium (sandpaper, buffing material, etc.) is now applied to recycled container 50 surface and secured (hot melt glue, contact cement, tape, etc.).

The embodiment illustrated in FIG. 2A is referenced as Fabricated Sealing Nipple. Fabricated sealing nipple 66B incorporates several parts into a single unit, those being threaded nipple 66, sleeved knob 72, and "O" ring 70. "O" ring 70 would be positioned within groove 71. Sleeved knob 72 would be replaced with the fabrication of flange 73. The fabrication of this part would result in an easier and more reliable sealing means for recycled container 50.

The embodiment illustrated in FIG. 2C is referenced as Threaded Nipple With Tightening Notches. Threaded nipple with tightening notches 66A allows for a means to hold, via slotted screwdriver, threaded nipple 66A. This minimizes slippage due to the inability to access the other end of threaded nipple 66A contained within recycled container 50.

OPERATION-FIG. 3

The embodiment illustrated in FIG. 3 is referenced as Handle Assembly. The handle assembly shows the addition of a supplemental handle to the configuration which increases control and stability to the operation. Handle 58 is held in position by two positioning collars 56, one of which is located in handle inset 59 (FIG. 3A) fabricated in one end of handle 58. This protects the operator from contact with the rotation of positioning collar 56 while allowing for handle 58 to be larger without also requiring shaft 54 to be longer. The flexibility of the tool configuration as a hand tool is demonstrated in FIGS. 3B and 3C; the rolling pin style and wand style respectively. With the repositioning of handle 58, the diversity of applications greatly increases the ability to access restricted areas where a handle would prevent entry without sacrificing the stability of a two-handed grip. The application as a stationary unit is also applicable as shown in FIGS. 3D and 3E; the horizontal mount and vertical mount respectively.

Slotted mounting bracket A 116 as shown in FIG. 3D is secured, with the slot toward the user, to an appropriate surface using base mounting bolt 120. A space equal to the separation between the two mounting bushings 124 is used to position slotted mounting bracket B 116A. The positions of mounting bushing 124 on shaft 54 is dependant on the size of recycled container 50 and the configuration being used. To mount the tool on mounting bracket A 116 and mounting bracket B 116A, shaft 54 is passed through the respective slot on both brackets to allow mounting bushing 124 to be positioned within the larger hole. To hold the horizontal location positioning collars 56 are used. While handle 58 is shown in the illustration, handle 58 is not a required part of the stationary mount. The purpose of showing handle 58 attached is to demonstrate the ease and quickness of converting from a portable hand tool to a mounted stationary tool and vice versa.

A reconfiguration of mounting bracket A 116 and mounting bracket B 116A illustrated in FIG. 3E demonstrates the ability to perform in a vertical mount. Mounting bracket B 116A is rotated to a position directly above mounting bracket A 116 with the slotted hole in the toe of the mounting foot toward the user and directly above the slotted hole in the toe of mounting bracket A 116. The slotted hole in mounting bracket B 116A is positioned off center to reflect the width of the column when attached to mounting bracket A 116 by using column mounting bolt 122 located on both sides of the large hole in the vertical columns. Mounting bracket A 116 would have to be located beyond the edge of the bench or table holding mounting bracket A 116 to allow for the space needed for the configuration chosen.

OPERATION-FIG. 4

The embodiment illustrated in FIG. 4A is referenced as Drive Pad Assembly With Drive Foot Added. This enhances the drive means when selected recycled container 50 has a non-flat bottom surface. Bolt hole 83 in drive plate 78 is aligned with bolt hole 83 in drive pad 80. Threaded drive foot 82 is positioned on the surface of drive pad 80 at the location of bolt hole 83 that corresponds to a convolution, ridge, contour, ripple, crevice, groove, or irregularity in recycled container 50 bottom surface. Drive foot bolt 84 passes through drive plate 78, drive pad 80, and extends slightly beyond drive pad 80 at which time threaded drive foot 82 is attached and tightened. When recycled container 50 is pressed against drive pad 80, threaded drive foot 82 is trapped in the contour of the bottom surface which results in an effective "keying" of recycled container 50 with the drive means (FIG. 4A).

The embodiment illustrated in FIG. 4B is referenced as Drive Assembly With Formed Drive Plate. Formed drive plate 88 is a speciality drive means fabricated to conform to a particular recycled container 50 bottom surface. This would produce an enhanced "keying" effect as referenced in previous paragraph. The use of drive pad 80 with formed drive plate 88 would be an option of the user. The application would be to act as a shock absorber between recycled container 50 and formed drive plate 88.

The embodiment illustrated in FIG. 4C is referenced as Drive Collar Using Flange Engaging. Drive collar with protruding flange 74A is a fabricated drive collar having a protrusion on the surface toward drive plate 78. The resulting mating is formed using only two pieces due to drive collar 78A incorporating the function of engaging pin 76 used in the preferred embodiment (FIG. 4).

The embodiment illustrated in FIG. 4D is referenced as Drive Pin. Drive pin 90 is the simplest form of transferring the rotation of shaft 54 to drive plate 78. Drive pin 90 would perform the function of fabricated drive collar 74A as shown in FIG. 4C without the capability of varying the position on shaft 54.

The embodiment illustrated in FIG. 4E is referenced as Drive Using Engaging Ring With Protruding Flanges. Engaging ring 92 is a variation using a ring with specific flanges on both sides to mate with split ring drive collar 74B and drive plate with engaging hole 78. A secondary characteristic would be to control the torque delivered to drive plate 78 by using flanges of varying strengths that would sheer should a peak torque be used. This would prevent damage to power source 51 at a minimal cost.

The embodiment illustrated in FIG. 4F is referenced as Drive Assembly With Non-circular Drive Engaging Means. Non-circular drive collar 96 and drive plate with non-circular center 94 is a variation of drive collar 74A mating with drive plate 78. This was referred to previously in FIG. 4C.

OPERATION-FIGS. 5 AND 6

The embodiment illustrated in FIG. 5 is referenced as Internal Drive Finger Assembly. Drive finger 98 connected to non-circular drive collar 96 is an internal drive means functioning in the same manner as threaded drive foot 82 illustrated in FIG. 4A. Non-circular drive collar 96 was used to maximize the diameter of the collar while the flat surface at the mounting points aid in stabilizing attaching appendage 97 of drive finger 98. A series of mounting holes in appendage 97 allows for adjustability in arm length to reflect the diameter of the various sizes of recycled containers 50 available. The length of drive finger 98 is maintained at a distance slightly greater than the space between shaft 54 and the interior wall of recycled container 50.

Non-circular drive collar 96 is tightened at a determined position on shaft 54 which, when engaging recycled container 50, will produce the desired configuration. Drive finger 98 is positioned next to shaft 54 and is inserted, drive finger 98 leading, through the neck of recycled container 50. Inside recycled container 50, drive finger 98 falls away from shaft 54 and lodges the tip of drive finger 98 in a convolution at the bottom surface of recycled container 50. Pressure is maintained against drive finger 98 by locating positioning collar 56 outside and against the sealing means (FIG. 2) opposite drive finger 98.

The embodiment illustrated in FIG. 6 is referenced as Internal Drive With Protruding Flange. Protruding flange 108 can be fixed or removable, with single or multiple flanges. Protruding flange 108 is positioned within recycled container 50. Recycled container 50 is filled with motion transmission medium 110 (expanded foam, sand, sawdust, high density fluid, etc.). Medium 110 transmits the rotating motion of shaft 54 via protruding flange 108 to recycled container 50. The shock effect of an instant stop to recycled container 50 would be lessened within medium 110, protecting power source 51 which is committed to shaft 54.

OPERATION-FIGS. 7 AND 8

The embodiment illustrated in FIG. 7 is referenced as Container Neck Drive Socket Assembly. Drive socket with engaging hole 100 is designed to mate with neck ring engaging slot 102 to be located at the neck-end of recycled container 50. The neck ring is modified by cutting a perpendicular slot of such width and depth as to allow engaging flange 101, located in the cavity of drive socket 100, to pass. Recycled container 50 is held with positioning collar 56 at and against the exterior of the sealing means (FIGS. 2 and 2D) at both ends.

Drive socket 100 is placed next to positioning collar 56 at the neck-end of recycled container 50. Drive socket 100 possesses a cavity of sufficient size to encompass positioning collar 56, cap 60 with sealing means (FIG. 2D), and neck ring engaging slot 102. Engaging flange 101, located within and near the outer edge of drive socket 100 cavity, is mated with neck ring engaging slot 102 cut in the neck ring of recycled container 50. Drive collar 74 with engaging pin 76 is positioned next to drive socket 100 with engaging pin 76 mating with the appropriate hole in drive socket 100. Depending upon the fit of drive socket 100, positioning collar 56 located within the cavity of drive socket 100, may be omitted due to drive socket 100 performing both functions.

FIG. 7A illustrates adapting insert for reducing 104 and adapting insert for enlarging 104A. As recycled container 50 comes in various sizes, adaptors provide a means of adjusting drive socket 100 to engaging neck rings of varying sizes. Set screw 106 is used to hold the adapter in position within drive socket 100.

The embodiment illustrated in FIG. 8 is referenced as Container With Pressurizing Means Through Container Wall. Container mounted valve 112 fills recycled container 50 with a substance (air, water, etc.) for producing desired weight and firmness. Valve 112 can also be mounted in cap 60 which would allow for easier transfer between similar recycled containers 50.

FIG. 8A illustrates a container with pressurizing means through shaft and uses shaft with hollow core 54A with shaft mounted valve 114 at the open core end of hollow core shaft 54A as a fill point. Recycled container 50 is installed in such a manner as to have within the internal cavity of recycled container 50, exit port 115 of hollow core shaft 54A. The desired substance is introduced through valve 114 and fills recycled container 50. If the hollow core travels the length of shaft 54A, the end opposite valve 114 must be sealed.

SUMMARY, RAMIFICATIONS, AND SCOPE

Accordingly, the reader will see that the present invention provides an economical, easy to use tool which works equally well on flat or curved surfaces. In addition, the attachment has the ability to change power units to suit the task and can reverse direction of rotation during use. Furthermore, the present invention has the additional advantages in that

- it permits utilization of abrasive material such as sandpaper in its most basic and least expensive form, that is, in the form of conventional, standard-size, rectangular, flat sheets which are low cost and easily available;
- it provides the ability to change configuration of the tool, primarily rolling pin, wand style, or mounted in various positions to meet the needs of the user and may be used by right-handed and left-handed persons with equal ease, coupled with the ability to better view the area being abraded, resulting in greater handleability;
- it permits the use of a multitude of drum container sizes producing a variety of speeds and sander widths thus adapting to individual needs;

it allows for a fluid, solid material, or gas filled drum which regulates the firmness of the drum, adds weight to the tool resulting in less bouncing during operation for a smoother finish, and absorbs heat produced by friction from the abrading operation, extending the useful life of the abrading material; and it allows for the recycling of plastic containers to an innovative and useful tool.

Although the description above contains many specificities, these should not be construed as limiting the scope of the invention but as merely providing illustrations of some of the presently preferred embodiments of this invention. For example, the attachment may be mounted on a permanent or temporary holder, or to a self-standing power source rather than being hand-held; the attachment may be used for buffing or polishing rather than for merely abrading; the attachment may adapt to a variety of non-finishing related purposes such as the stirring of paint and the rolling up of rope, string, or wire etc.

Although the invention has been described in its preferred embodiments, it is understood that it is not limited thereto but is susceptible to changes and modifications as can be made by one having ordinary skill, thus the scope of the invention should be determined by the appended claims and their legal equivalents, rather than by the examples given.

I claim:

1. A method of using a rotary abrading, sanding, or polishing device, comprising:

(a) providing a power source, (b) providing a container having a surface treatment material therearound, (c) securing said container to said power source with a securing device, the securing device comprising:

(i) a shaft (ii) an attaching means mounted on said shaft, and (iii) a positioning device for selectively axially positioning said container, and (e) attaching a drive engaging device to said shaft whereby said power source produces a motion in said container.

2. The method as claimed in claim 1 wherein the securing device and the drive engaging device are combined as a single piece.

3. For use in a rotary sanding, abrading, or polishing device wherein a container for supporting sandpaper is used as a drum, a drum attachment comprising:

(a) a shaft (b) an attaching means mounted on said shaft for securing said container to said shaft, (c) a container positioning device mounted on said shaft for selectively axially positioning said container in different axial locations along said shaft, and (d) a drive engaging device for engaging and/or positioning said container whereby said container can be rotated.

4. The attachment as claimed in claim 3 wherein the attaching means is a multiple sealing device comprising:

(a) an externally threaded nipple capable of being positioned through a mounting hole in the container wall having a hole of sufficient size to allow said shaft to pass therethrough, (b) a shoulder nut having a flange positioned next to an end of said threaded nipple, and a sealing material between the flange of the shoulder nut and an end of said threaded nipple thereby producing a dynamic seal between said threaded nipple, said shoulder nut, and said shaft when the shoulder nut is tightened, (c) a sealing material placed around said threaded nipple between the flange of said shoulder nut and the container wall, (d) a washer positioned around said threaded nipple on an opposite side of said container wall from said sealing material contacted by the flange of said shoulder nut, and (e) a nipple nut positioned next to said washer which when tightened produces a seal between said container wall and the flange of said shoulder nut, thereby securing said container to said shaft.

5. The attachment as claimed in claim 1 wherein the attaching means comprising:

(a) a single formed tube having a hole with a diameter approximately the same as a diameter of said shaft, and having a sufficient length to penetrate said container wall, a flange mounted on said tube, protruding from the center of said flange and said formed tube having threads thereon, (b) a sealing means mountable between said flange and a side of said container wall, (c) a washer mountable between said flange and said container wall, and positionable around said formed tube on an opposite side of said container wall from said sealing means, (d) a nipple nut positionable next to said washer which when tightened produces a seal formed by said sealing means between said container wall and the flange of said formed tube, thereby securing said container to said shaft, and (e) a shaft sealing means located in the interior of said formed tube.

6. The attachment as claimed in claim 3 wherein an auxiliary handle is mounted on and rotatable relative to said shaft thereby allowing for said selective axial positioning of said container.

7. The attachment as claimed in claim 3 wherein said shaft and said drive engaging device are coupled.

8. The attachment as claimed in claim 3 wherein said drive engaging device is capable of adjusting to the contour of said container.

9. The attachment as claimed in claim 3 wherein a protrusion on said shaft engages said drive engaging device.

10. The attachment as claimed in claim 1 wherein the drive engaging device has a friction pad which is capable of engaging and rotating said container.

11. The attachment as claimed in claim 1 wherein the drive engaging device is molded or formed from a material capable of conforming to a surface of said container for rotating said container.

12. The attachment as claimed in claim 3 wherein said shaft has a finger attached thereto for engaging and rotating said container.

13. The attachment as claimed in claim 3 in combination with mounting brackets wherein said shaft can be mounted in a vertical, horizontal, or other angled position.

14. The attachment as claimed in claim 3 wherein said attaching means and said drive engaging device are combined.

15. A rotary sanding, abrading, or polishing device comprising:

(a) a drum which is a container for supporting a surface treatment material therearound, (b) a drum attachment comprising:

(i) a shaft (ii) an attaching means mounted on said shaft for securing said container to said shaft (iii) a container positioning device mounted on said shaft for selectively axially positioning said container in different axial locations along said shaft, and (iiii) a drive engaging device for engaging and/or positioning said container whereby said container can be rotated (c) wherein said container is filled with a substance possessing the ability to transmit motion.

16. The attachment as claimed in claim 15 wherein said engaging device includes means for engaging the substance and thereby rotating said container.

17. The device as claimed in claim 15 wherein the container is a plastic soda bottle.

18. The device as claimed in claim 15 wherein said container is filled with said substance through a cap on said container.

19. The device as claimed in claim 15 wherein said container is filled with said substance through a valve means positioned in the container wall.

20. The device as claimed in claim 15 wherein a valve means is mounted in a cap on said container for introducing said substance into said container.

21. The device as claimed in claim 15 wherein a valve means is located in an end of said shaft and a hollow core extending from said valve means through said shaft to an aperture located within said container for introducing said substance into said container.

* * * * *